US008622113B1

(12) United States Patent
Rau, III

(10) Patent No.: US 8,622,113 B1
(45) Date of Patent: Jan. 7, 2014

(54) APPARATUS AND METHOD FOR CONTROLLED OPTIMIZED RAPID DIRECTIONAL SOLIDIFICATION OF MOLD SHAPED METAL CASTINGS

(71) Applicant: Charles B. Rau, III, Gig Harbor, WA (US)

(72) Inventor: Charles B. Rau, III, Gig Harbor, WA (US)

( * ) Notice: Subject to any disclaimer, the term of this patent is extended or adjusted under 35 U.S.C. 154(b) by 0 days.

(21) Appl. No.: 13/621,271

(22) Filed: Sep. 16, 2012

(51) Int. Cl.
*B22C 9/04* (2006.01)

(52) U.S. Cl.
USPC ..... 164/34; 164/37; 164/122.1; 164/348

(58) Field of Classification Search
USPC ..... 164/122–128, 134, 37–39, 348, 349, 164/379, 520
See application file for complete search history.

(56) References Cited

U.S. PATENT DOCUMENTS

| | | | | |
|---|---|---|---|---|
| 3,608,617 | A * | 9/1971 | Burke et al. | 164/126 |
| 4,585,047 | A * | 4/1986 | Kawai et al. | 164/126 |
| 5,215,143 | A * | 6/1993 | Gentry | 164/529 |
| 2007/0277952 | A1 * | 12/2007 | Le Vert et al. | 164/34 |
| 2008/0041499 | A1 | 2/2008 | Grassi et al. | |

* cited by examiner

*Primary Examiner* — Kevin P Kerns
*Assistant Examiner* — Kevin E Yoon
(74) *Attorney, Agent, or Firm* — William A. Jeckle

(57) ABSTRACT

A method and apparatus for directionally controlled rapid solidification of a molten metal casting provides modified mold flasks containing mold media defining a mold cavity into which molten metal is poured and thereafter solidified. The mold media is fluid permeable and electrically and thermally conductive so that coolants passing through the media conduct heat away from the molten metal to promote solidification. Apparatus carried upon and within the mold flask allow controlled application of coolants to dissipate heat in a controlled manner to promote solidification in a controlled direction. Ports defined in the flasks, spaces between the mold media particulates and coolant, directionally applied by a movable cooling ring provide controlled directional cooling and castings having improved mechanical characteristics, with greater speed and increased efficiency.

13 Claims, 15 Drawing Sheets

Relationship Between Dendrite Cell Size and Solidification Rate for Aluminum Alloys (After Spear and Gardner)

APPARATUS AND METHOD FOR CONTROLLED OPTIMIZED RAPID DIRECTIONAL SOLIDIFICATION OF MOLD SHAPED METAL CASTINGS

RELATED APPLICATIONS

This utility patent application claims the benefit of earlier filed U.S. Provisional Patent Application No. 61/573,965 filed on Sep. 16, 2011, titled Apparatus and Method for Controlled Optimized Rapid Directional Solidification of Mold Shaped Metal Castings, and also claims the benefit of earlier filed U.S. Provisional Patent Application No. 61/686,668 filed on Apr. 11, 2012 titled Improved Apparatus and Method for Controlled Optimized Rapid Directional Solidification of Mold Shaped Metal Castings. The entire content of each above identified U.S. Provisional Patent Application is expressly incorporated herein by this reference thereto.

BACKGROUND OF INVENTION

1. Field of Invention

The present invention relates to casting metals. More particularly, the present invention relates to an apparatus and method for controlled optimized directional rapid solidification of metal castings to improve mechanical characteristics of the casted metal and the casting.

2. Background

The casting of molten metal into desired shapes has been known and practiced for centuries. Known molten metal casting processes involve pouring, or forcing, molten metal into a mold cavity. Through the loss of heat, the molten metal within the mold cavity solidifies creating a cast part in the shape of the mold cavity.

Molten metal casting employs a variety of techniques and a variety of apparatus, including, but not limited to permanent molds, sand casting, die casting, and investment casting.

Permanent molds, which may be formed of hardened steel, are well suited for casting detailed objects, having thin walls and intricate structures. One recognized drawback however is that permanent molds are expensive.

Sand casting is a process where a mold cavity (or depression) is formed in sand with a mold pattern having a shape similar to the desired casting. If the finished casting is to be hollow or define internal cavities or passages, such internal passages are formed with "cores" that are placed within the cavity/depression formed in the sand. Some sand casting methods use "green sand" which is a mixture of clay and moisture that together function as a binder for the sand aggregate. Other forms of sand binders, such as resins and chemicals may also be used for higher levels of hardness and improved accuracy. Unfortunately, sand binders are subject to Environmental Protection Agency (EPA) regulations and restrictions because the byproducts such sand binders generate during decomposition caused by heat are poisonous and/or hazardous. EPA regulations and restrictions have increased the cost of using resin and chemical binders in sand casting processes.

Die casting is a process similar to the permanent mold process where molten metal is forced, under high pressure, into a mold cavity which is formed by plural hardened steel dies which have been machined into a desired shape. The die casting process is somewhat similar to known injection molding processes.

Investment casting also known as the lost pattern process or lost foam process (hereinafter lost foam casting) is a method to cast metal items requiring smooth finished surfaces.

Lost foam casting is a variation of sand casting but is an improvement thereover because it provides better net shape capabilities as compared to green sand casting methods and eliminates parting lines and matching operations that increase costs. The lost foam process also provides better dimensional tolerances as compared to green sand castings because core shifts and core variabilities are eliminated. A direct benefit is a significant reduction in finish machining costs and infrastructure investment due to the high net shape of the casting, with less opportunities for errors in matching and assembly.

In the lost foam process, a pattern is made and thereafter sacrificed, when the molten metal is poured. A variety of pattern materials may be used, such as but not limited to wax, polystyrene foam, polyethylene foam, and other known pattern forming materials. For purposes of this disclosure, the patterns described herein are formed of foam, although it is to be understood that any known pattern making material may be used.

The lost foam process involves the formation of a foam pattern by injection of foam into a cavity defined by a die so that the foam completely fills the die cavity and conforms to the interior shape of the die cavity. Plural individually formed foam patterns may be combined to form a single complex pattern. The pattern is thereafter dipped into a medium that forms a coating covering the pattern. The coating is dried, resulting in a hardened exterior surface encasing the pattern. Thereafter, the coated pattern is placed in a mold flask, also known as a mold container. Backing media, such as sand, is packed around the coated pattern to provide support for the coated pattern when molten metal is added. Typically the backing media is packed around the coated pattern using a known mechanical vibration means such as a vibration table upon which the mold flask containing the coated pattern and backing media is placed. Because the "loaded" mold flask is a massive and heavy assembly it typically requires significant industrial infrastructure to maneuver and process. Sand which is the most commonly used backing media is heavy weighing on average between 100-120 lbs. per cubic foot. Further, sand is not eclectically conductive and has low thermal conductivity and is not conducive so it does not provide rapid heat dissipation.

A crucible or similar vessel containing molten metal is used to pour molten metal into a runner that communicates with the pattern. As the molten metal contacts the foam pattern, the foam decomposes and is vaporized. The molten metal replaces the foam pattern within the hardened coating which maintains the desired shape of the casting and the desired surface characteristics. The backing media surrounding the coated pattern provides stability while the metal cools and solidifies.

The mold flask is thereafter set aside to allow the molten metal to cool and solidify. This process is known as "freezing". Once freezing is complete, the cast part may be removed from the mold flask. As mentioned previously, sand has low thermal conductivity and, as a result, each casting takes a significant amount of time freeze. (e.g. multiple hours). The hardened coating is removed from the cast part by a variety of processes known to those skilled in the art and the backing media (the sand) is typically reclaimed and reused. The cast part may then be tempered by a variety of means and methods and thereafter finish machining may occur.

Unfortunately, the lost foam process has known drawbacks. The vaporization of the foam pattern generates fumes that are noxious and/or poisonous. The decomposing foam pattern cools the molten metal which may cause defects within the cast part and may also release hydrogen gas, which may be captured within the molten metal as it freezes, causing defects in the cast part. The absence of uniform density of the foam may prevent smooth and predictable filling of the mold cavity allowing the molten metal to advance more rapidly in one section of the mold cavity and then "fold back" as other sections of the mold cavity are filled, thereby enfolding defects within the casting.

Another drawback to the lost foam process is associated with the slow cooling of the cast metal. As described previously, after the molten metal is poured into the mold cavity, the filled mold and surrounding mold flask are set aside until sufficient heat has dissipated from the metal so that the metal has solidified, whereupon the casting within the mold cavity may be removed from the mold flask. This period of time may be lengthy, (multiple hours) and the slow cooling of the molten metal is known to cause low quality castings which do not provide desirable and sought-after mechanical properties, and may include inferior granular micro-structures within the casted piece. Movement of the massive, heavy and hot mold flask requires specialized lifting equipment and the length of time for the freeze to occur necessitates a long production cycle because the mold flasks cannot be utilized again until the freeze has occurred and the casting and mold media has been removed from the flask.

Another drawback to known lost foam casting, and slow cooling, is that the casting requires subsequent solution heat treatment, which increases costs and increases production time.

An event further drawback to known lost foam casting process is that the solidification of the molten metal is uncontrolled. (i.e. is not directional).

A variety of means, methods and apparatus have been attempted to improve known lost foam casting processes but the drawbacks have remained. One example of an improvement to lost foam casting uses sand aggregates and a water soluble binder and is known as the "ablation casting process" disclosed in U.S. patent application Ser. No. 11/505,019 (Patent Publication No.: US 2008/0041499A1). In the ablation process, rapid solidification of the cast piece is achieved by cooling the sand mold with water similar to a "carwash" that washes away the backing sand and water soluble binders (ablation) to speed the cooling.

Although the ablation process is an improvement over prior methods and apparatus and is more controlled than "submerging" a mold flask containing a casting into a tub of coolant, there continue to be various recognized problems, difficulties and drawbacks with lost foam casting, including, but not limited to: (1) controlling the mold cavity filling; (2) weak mold patterns; (3) hydrogen porosity control; and (4) fold defects. For example and without limitation, the ablation process does not provide a means for creating controlled multi-directional intersecting freeze-fronts in a casting and the ablation process is extremely "messy" and requires installation and maintenance of the "car wash" apparatus into which the hot flasks are "fed".

As noted previously, the mold backing media commonly used in lost foam casting is sand. Most commonly, the sand used is silicon or zircon, both of which have low thermal conductivity such that heat is not conducted away from the molten metal causing a slow solidification rate. This is a significant drawback because it is well-known that rapid cooling of the molten metal is desirable because of improved mechanical properties of the casting, as well as the number of operation steps that may be eliminated with rapid cooling. Moreover, rapid cooling causes retention of a greater portion of the alloying elements in solution and may also allow elimination of subsequent heat treatments, which saves time and expense.

Various methods and techniques to overcome and improve the mechanical properties of lost foam cast items have been attempted, but there remains a significant need for a "lost foam" casting process that provides for rapid directional cooling and rapid directional solidification of the cast piece while simultaneously providing desired mechanical properties of the casted item that result from rapid cooling and rapid solidification.

As noted previously, known "lost foam" casting processes produce cast items having low to average mechanical properties because of the slow cooling and slow solidification rate and as a result, items formed through known "lost foam" casting processes, are typically not capable of being used in applications requiring high-strength, such as aerospace applications and military applications.

What is needed is an apparatus and method that provides all the advantages of lost foam casting with controllable optimized thermal management that provides optimized rapid cooling and optimized controlled directional solidification, including directional solidification from multiple directions.

My apparatus and method overcomes various of the aforementioned drawbacks to the lost foam process by providing improved mold flasks that are used in conjunction with a new mold media and an improved cooling method that provides for controlled optimized directional rapid cooling and optimized solidification of molten metal castings.

My mold backing media is synthetic carbon graphite. My carbon graphite mold media is light weight, weighing on average about 3-15 lbs. per cubic foot. My carbon graphite mold media is highly thermally conductive with a conductivity of up to 1,700 W/m·K (watts per meter Kelvin) as compared to Copper which has a thermal conductivity of approximately 400 W/m·K. Further, my carbon graphite mold media is highly electrically conductive nearly matching the electrical conductivity of copper. My carbon graphite mold media is produced by high-temperature treatment of amorphous carbon materials. The primary feedstock for making synthetic graphite is calcined petroleum coke and coal tar pitch, both of which are highly graphitizable forms of carbon. The manufacturing process consists of mixing, molding, and baking operations followed by heat-treatment to temperatures between approximately 2500C and 3000C. The heat drives the solid/solid, amorphous carbon-to-graphite phase transformation. The morphology of synthetic graphite varies from "flaky" in fine powders to irregular round grains in coarser products which is caused by high temperature vaporization of volatile impurities, which include most metal oxides, sulfur, nitrogen, hydrogen, and all organic components that were part of the original petroleum or coal tar pitch. The available particle size range is generally from approximately small 2-micrometer powders to 3 cm pieces, although larger particles may also be obtained. The "near spherical" shape is a preferred embodiment because of the need for "spaces" and "gaps" between the individual particles when supporting a mold in a mold flask. In an alternate embodiment, the thermally and electrically conductive mold backing media may be mixed with silica sand, or other larger mostly round in shape mold material medias in the interest of economics. Copper coated synthetic graphite or other materials such as copper coated "Iron Buck-shot" is another alternate mold material media because of its conductivity. The exterior shape of the mold media particulates facilitates deployment and passage of coolants.

My invention provides a mold flask that operates with a coolant system for controlled optimized directional rapid freezing of molten metal.

My invention provides mold media that is electrically conductive and thermally conductive for heating the mold prior to pouring molten metal into the mold, and also to quickly dissipate heat from the molten metal to provide rapid cooling and a controlled solidification freeze front.

My invention provides mold media that is recyclable, does not use binders and does not generate polluting or other dangerous byproducts.

My invention provides mold media that is aggregate, defining generally spherical shaped particles that allow coolant to permeate through the media to draw heat away from the molten metal cast.

My invention provides for controlled rapid directional cooling of a molten metal casting to enhance the mechanical characteristics and optimizes the solidification cooling rate by the temperature gradient affecting the alloying elements within the molten metal within the mold cavity.

My invention provides an apparatus and method that is operable with liquid coolants and gaseous coolants.

Some or all of the problems, difficulties and drawbacks identified above and other problems, difficulties, and drawbacks may be helped or solved by the inventions shown and described herein. My invention may also be used to address other problems, difficulties, and drawbacks not set out above or which are only understood or appreciated at a later time. The future may also bring to light currently unknown or unrecognized benefits which may be appreciated, or more fully appreciated, in the future associated with the novel inventions shown and described herein.

BRIEF SUMMARY OF THE INVENTION

A method and apparatus for directionally controlled rapid solidification of a molten metal casting provides modified mold flasks containing mold media defining a mold cavity into which molten metal is poured and thereafter solidified. The mold media is fluid permeable and electrically and thermally conductive so that coolants passing through the media conduct heat away from the molten metal to promote solidification. Apparatus carried upon and within the mold flask allow controlled application of coolants to dissipate heat in a controlled manner to promote solidification in a controlled direction. Ports defined in the flasks, spaces between the mold media particulates and coolant, directionally applied by a movable cooling ring provide controlled directional cooling and castings having improved mechanical characteristics, with greater speed and increased efficiency.

In providing such an apparatus and method for controlled optimized rapid directional solidification of mold shaped metal castings, it is:

a principal object to provide an apparatus and method which provides the advantages of "lost foam" casting processes, namely a high net shape to reduce after casting machining costs, while simultaneously providing rapid cooling rates that produce improved mechanical properties.

a further object to provide improved mold flasks that are used in conjunction with a new mold media and an improved cooling method for controlled optimized directional rapid cooling and optimized solidification of molten metal castings.

a further object to provide a mold media that is electrically conductive and thermally conductive for heating the mold prior to pouring molten metal into the mold, and also to quickly dissipate heat from the molten metal to provide rapid cooling and a controlled solidification freeze front.

a further object to provide a mold backing media that is recyclable, does not use binders and does not generate polluting or other dangerous byproducts.

a further object to provide a mold backing media that is aggregate, defining generally spherical shaped particles that allow coolant to permeate through the media to draw heat away from the molten metal casting.

a further object to provide controlled rapid directional cooling of a molten metal casting to enhance the mechanical characteristics.

a further object to provide optimization of the solidification cooling rate by the temperature gradient affecting the alloying elements within the molten metal.

a further object to provide an apparatus and method that is operable with liquid coolants and gaseous coolants.

a further object to provide an apparatus and method that speeds cycle times of molten metal casting operations.

a further object to provide an apparatus and method that allows mold flasks to be re-used more quickly by reducing cycle times.

a further object to provide an apparatus and method that allows pre-packing of support flasks and screen flasks with mold patterns without the need to pack the mold flask.

a further object to provide an apparatus and method that allows molds to be pre-heated electrically in order to vaporize the foam mold patterns and prevent casting defects.

a further object to provide an apparatus and method that is lighter in weight than sand mold backing media.

a further object to provide an apparatus and method that is more thermally conductive than sand allowing for rapid cooling of molten metal castings.

Other and further objects of my invention will appear from the following specification and accompanying drawings which form a part hereof. In carrying out the objects of my invention it is to be understood that its structures and features and steps are susceptible to change in design and arrangement and order with only one preferred and practical embodiment of the best known mode being illustrated in the accompanying drawings and specified as is required.

BRIEF DESCRIPTION OF THE DRAWINGS

Preferred forms, configurations, embodiments and/or diagrams relating to and helping to describe preferred aspects and versions of my invention are explained and characterized herein, often with reference to the accompanying drawings. The drawings and features shown herein also serve as part of the disclosure of my invention, whether described in text or merely by graphical disclosure alone. The drawings are briefly described below.

DETAILED WRITTEN DESCRIPTION

Introductory Notes

Figure 1:
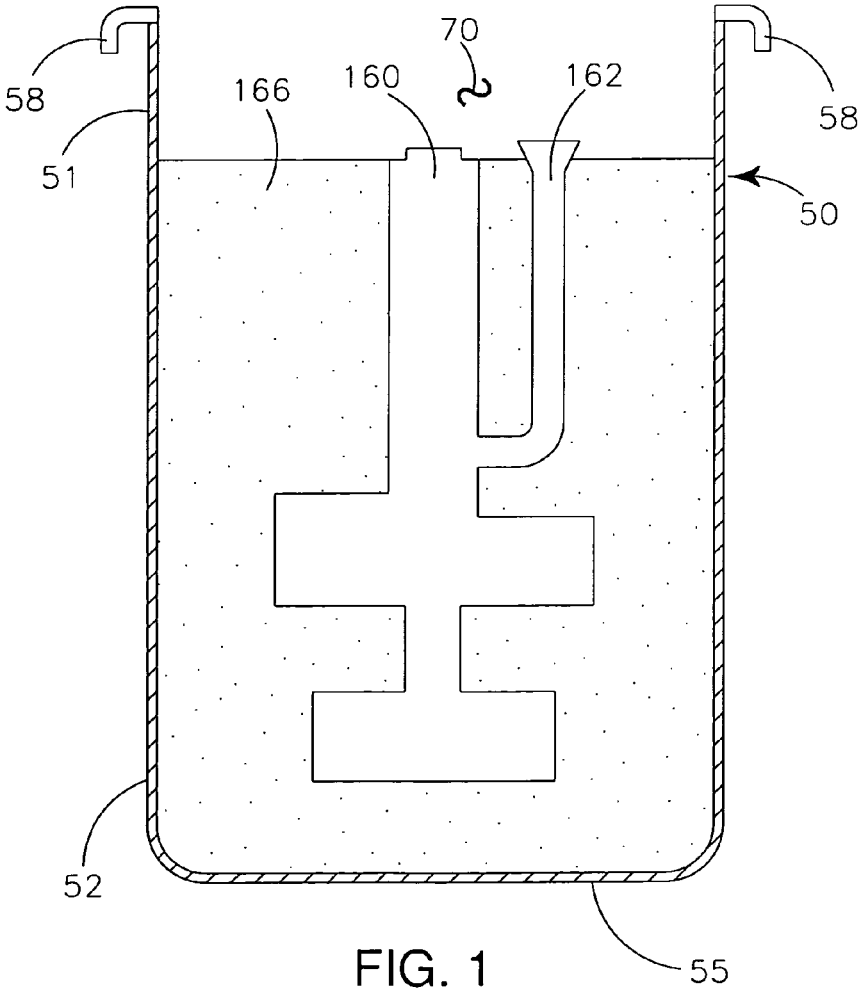
FIG. 1 PRIOR ART
FIG. 1 is a orthographic vertical cross-section view of a prior art mold flask containing a coated foam pattern supported in a sand backing media.

The readers of this document should understand that dictionaries were used in the preparation of this document. Widely known and used in the preparation hereof are *The American Heritage Dictionary,* 4th Edition (© 2000), *Webster's New International Dictionary*, Unabridged, (Second Edition ©1957), *Webster's Third New International Dictionary* (© 1993), *The Oxford English Dictionary* (Second Edition, ©1989), and *The New Century Dictionary* (©2001-2005), all of which are hereby incorporated by this reference for interpretation of terms used herein, and for application and use of words defined in such references to more adequately or aptly describe various features, aspects and concepts shown or otherwise described herein using words having meanings applicable to such features, aspects and concepts.

This document is premised upon using one or more terms with one embodiment that may also apply to other embodiments for similar structures, functions, features and aspects of the inventions. Wording used in the claims is also descriptive of the inventions, and the text of both claims and abstract are incorporated by this reference into the description entirely.

The readers of this document should further understand that the embodiments described herein may rely on terminology and features used in any section or embodiment shown in this document and other terms readily apparent from the drawings and language common or proper therefore. This document is premised upon using one or more terms or features shown in one embodiment that may also apply to or be combined with other embodiments for similar structures, functions, features and aspects of the inventions and provide additional embodiments of the inventions.

My apparatus and method for controlled optimized rapid solidification of mold shaped metal castings may be deployed in a tiered approach and generally comprises a conductive mold flask 50, and particulated carbon graphite mold media 40 that is thermally conductive and electrically conductive.

In its most simple version, known mold media such as, but not limited to, green sand, silica sand, and/or zircon sand is replaced with my synthetic carbon graphite mold media 40 in a casting process. The thermal conductivity of my carbon graphite mold media 40 rapidly draws heat away from a casting 168 providing for more rapid cooling and increased mechanical characteristics of the casting 168. The object is to provide for controlled rapid cooling and also to control the direction of freezing of the molten metal.

It is well known that uncontrolled rapid cooling of molten metal is not desirable and does not produce quality metal parts with sought after mechanical properties. Uncontrolled rapid cooling frequently leads to brittleness and warping. The goal, which is accomplished by the apparatus and method therein, is to control and optimize the cooling rates and cooling direction.

In a more complex version, a mold flask 50 may be modified with coolant inflow ports 59 and outflow ports 60 to control and optimize the rate and direction of cooling of the molten metal within a mold cavity 165 and to control solidification. The rate of cooling may be further accelerated by coupling a cooling means 140 to the mold flask 50 to draw coolants into the mold flask 50 and through the mold media 40. With use of thermal couples 169, timed sequences (not shown), and control of various inflow ports 59, and outflow ports 60 defined in the mold flask 50 that may be opened and closed as desired, my apparatus and method allows control of the direction of the freeze front and the rate of cooling of the molten metal to optimize the quality and mechanical characteristics of the cast metal and the cast part.

In a further embodiment, a fine powdered mixture of my synthetic carbon graphite mold media 40 is combined with a water-soluble binder/adhesive to form a coating 161 that is applied to an expanded foam mold pattern 160. The carbon graphite coating 161, because it is electrically conductive, allows preheating of the mold 160 to prevent defects such as metal folding during mold cavity 165 filling. Further, preheating of the mold 160 may be used to enhance metal flow dynamics during the mold cavity 165 fill. The aforementioned preheating technique is in its infancy of development, however mold preheating has been successfully deployed with certain mold cavity 165 configurations. It is believed the preheating capability described herein is the foundation for such refinements in the future.

In an even further embodiment, a solid block of synthetic carbon graphite mold media 40 is formed through known means to compress the particulates 41 into a solid block (not shown). Thereafter, the block of mold media 40 may be machined as desired to create a mold cavity 165 for casting a part. Thereafter, the block of mold media 40 defining the machined mold cavity 165 may be placed in a mold flask 50 and surrounded by the synthetic carbon graphite mold media 40. The formation of the mold cavity 165 from a block (not shown) of the carbon graphite media 40 is much less expensive than the formation of known permanent molds (not shown) because the carbon graphite mold media 40 is softer than hardened tool steel, and yet the carbon graphite die cavity 167 also has significantly more rigidity and strength than standard coated foam mold patterns 160. Further, the absence of foam within the mold pattern 160 eliminates the possibilities of pre-cooling of the molten metal as the foam decomposes and prevents entrapment of volatile organic compounds such as hydrogen that may lead to undesirable porosity of the casting 168.

In a still further embodiment, an annular spray ring 120 that communicates with a coolant source is moveably carried on a track means 128 within a volume 70 defined by the mold flask 50. The spray ring 120 circumferentially surrounds a support flask 100 defining an interior volume 116 within which is carried a screen flask 80 carrying the mold media 40 and mold pattern 160. The spray ring 120 is moveable relative to the support flask 100 and screen flask 80 inside the volume 70 defined by the mold flask 50. Plural spacedly arrayed spray nozzles 132 are carried upon an inner circumferential surface 125 of the spray ring 120 for spraying coolant (which may be fluidic, or gaseous) onto an outer circumferential surface 103 of the support flask 100 and also the outer circumferential surface 80 of the screen flask 80. The spray ring 120, the spray nozzles 132 and coolant (not shown) discharged from the spray nozzles 132 can be positioned, directed, adjusted and moved to provide cooling at predetermined areas of the support flask 100, screen flask 80 and mold media 40 to cause rapid cooling and rapid solidification of the casting 168. The spray nozzles 132 may be activated, deactivated and adjusted by known valving/pressure means and aperture size (not shown) to control volume of coolant discharge to effect the cooling of the mold media 40 and casting 168 contained therein. The nozzles 132 are capable of discharging a variety of coolants including, but not limited to water, water blends, oils, oil blends, non-flammable distillates, and gases, including, but not limited to carbon dioxide, nitrogen, nitrogen/helium, chilled ambient air and the like.

It is well known that uniformity of internal metallic microstructure of a metal casting 168 provides improved mechanical characteristics and such uniformity of the microstructure of the casting 168 is more effectively created by using a combination of cooling methods/techniques. Combining a rising fluid level and my spray ring 120 that directs coolant onto pre-determined areas of the support flask 100 and screen flask 80 containing the casting 168 that are known to have slower cooling rates (known as hot spots) provides such a combination of cooling methods.

As another example, during a casting using the lost foam process and my new apparatus and method that combines rising coolant liquids with coolant gasses (which is particularly useful in the casting of steel and iron) the volume 70 containing the support flask 100, the screen flask 80, the mold media 40 and the mold pattern 160 may be flooded with a preheated cooling oil (not shown) which penetrates through spaces 43 between the mold media particulates 41 to cool the mold pattern 160 to a predetermined temperature. Thereafter, the cooling oil (not shown) may be drained from the mold flask 50 and a coolant gas may be sprayed from the spray ring 120 onto the support flask 100, the screen flask 80 and mold media 40 to cause further cooling of the casting 168 to create the sought-after mechanical properties. Use of combined cooling techniques (rising cooling liquid and cooling gas) tends to avoid thermal shock and provides for greater control of the freeze front and solidification. Although this example describes use of a cold gas following the flooding and draining of the mold flask 50 with a preheated oil, it is anticipated the order of the application of the cooling agents may be reversed and that other cooling agents may also be applied concurrently as well as sequentially to achieve the desired mechanical properties and to avoid known drawbacks.

One of the principal advantages of my movable annular spray ring 120 is its simple construction and its ability to provide the desired material characteristics of lost foam casting, namely high net shape in combination with high mechanical properties for the casting 168.

In the preferred embodiment, the mold flask 50 is electrically conductive and thermally conductive and is formed of a material such as, but not limited to, ferrous materials, copper or copper alloys. Electrical terminals 61 and 62 may be fastened to the mold flask 50 at spaced apart positions to provide for electrical current to be passed through the mold media 40 contained within a volume 70 defined by an interior portion of the mold flask 50. The mold flask 50 may have a variety/configurations such as, but not limited to cylindrical, square, rectangular or the like. For purposes of this disclosure, the configuration of the mold flask 50 is assumed to be cylindrical. The mold flask 50 defines an interior volume 70 with an interior diameter 69 and having a first top end portion 51, a second bottom end portion 52, an outer circumferential surface 53, an inner circumferential surface 54, an exterior bottom surface 55, an interior bottom surface 56 and a radially enlarged rim 57 extending circumferentially about the first top end portion 57 on the outer circumferential surface 53. Manipulating hooks 58 are interconnected to the outer circumferential surface 53 proximate the radially enlarged rim 57 to enable the mold flask 50 to be manipulated and moved with an overhead crane (not shown) or other known lifting and moving devices. Legs 71 extend downwardly from the exterior bottom surface 56 the mold flask 50 which may also define plural spacedly arrayed coolant in flow ports 59 and plural spacedly arrayed coolant outflow ports 60 which may have port closures 63 thereon to restrict inflow and/or outflow of coolant. A lid 64 may be removably attached to the first top end portion 51 with a hinge 65 and may be secured in a closed orientation with a known lid fastener 66 that secures the lid 64 in a closed position, even while under extreme pressure from steam and the like.

Pot supports 67 (FIGS. 14, 15, 16) carried on the interior bottom surface 56 provide a "seat" for a support flask 100 that may be carried in the volume 70. The pot supports 67 also function to ensure that coolants input into the volume 70 of the mold flask 50 below the support flask 100 flow into and through the support flask 100 and mold media 40 rather than passing upwardly and around the support flask 100.

Figure 13:
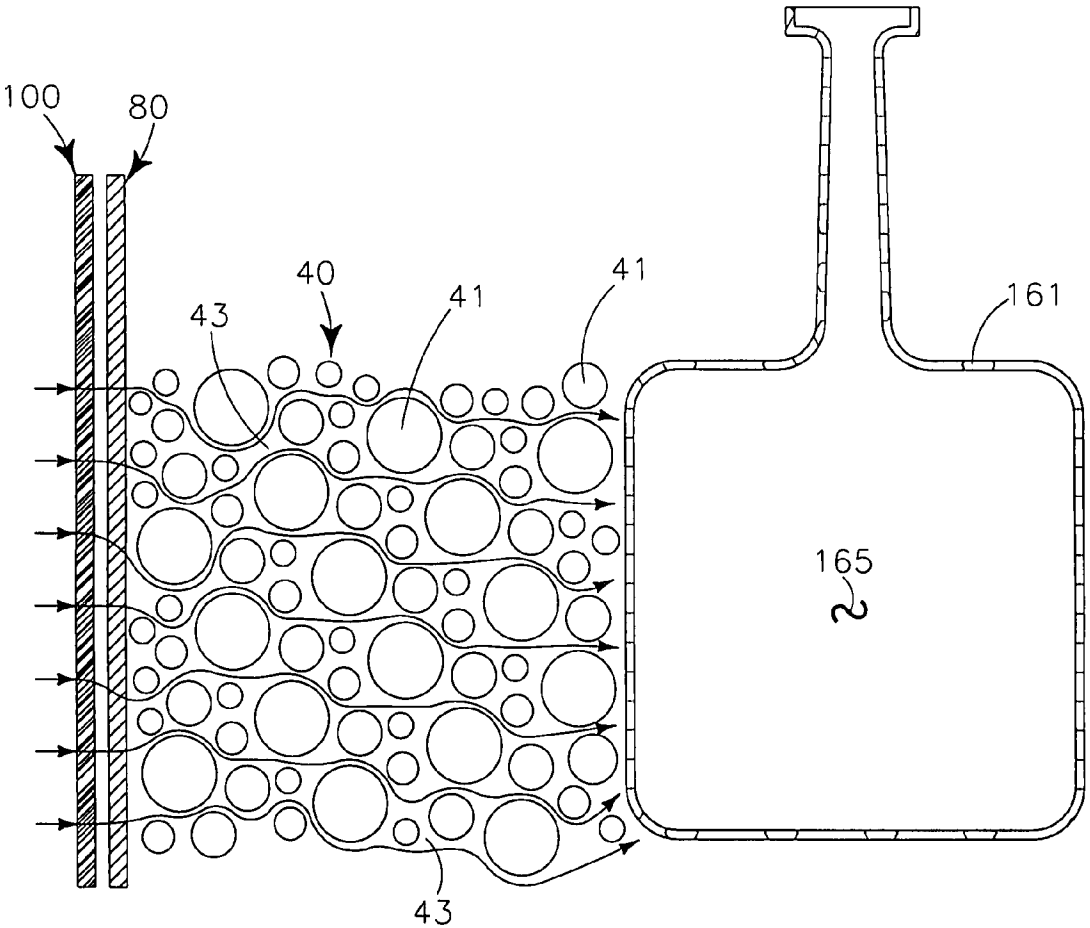
FIG. 13 is an artist's rendition of an enlarged portion of the support flask and screen flask containing mold media and a metal casting with arrows showing the flow of coolant through the support flask and screen flask to reach the casting and dissipate heat therefrom.

In the preferred embodiment, the mold media 40 is synthetic carbon graphite particulate that is thermally conductive and electrically conductive. More preferably, individual mold media particulates 41 are generally spherical in configuration so that when a plurality of particulates 41 are packed proximate to one another, there remain spaces 43, voids and gaps therebetween for passage of coolant around and between the particulates 41. (FIG. 13).

The synthetic carbon graphite mold media 41 is a manufactured product made by high-temperature treatment of amorphous carbon materials. The manufacturing process consists of mixing, molding, and baking followed by heat-treatment to temperatures between approximately 2500° C. and 3000° C. The heat drives the solid/solid, amorphous carbon-to-graphite phase transformation which vaporizes volatile impurities including metal oxides, sulfur, nitrogen, hydrogen, and all organic components. As a result of the thermal treatment, the mold media 40 has high purity. "Near spherical" in shape is the preferred embodiment because of the need for spaces 43 and gaps between the particles 41 to facilitate deployment and passage of coolants. In an alternate embodiment, the thermally and electrically conductive mold media 40 may be mixed with silica sand (not shown), or other larger mostly round in shape mold material media (not shown) in the interest of economics. Copper coated synthetic graphite or other materials such as copper coated "Iron Buckshot" (not shown) is another alternate mold material media because of its conductivity.

The high thermal conductivity of the mold media 40 does not require coolant to penetrate completely from a laterally outer portion of the mold media 40, proximate the mold flask 50, to the coating 160 of the mold 160. Because temperature is transferred so efficiently by the mold media 40, application of coolant onto laterally outwardly portions of the mold media 40 proximate the mold flask 50 has a near instantaneous cooling effect that is transferred inwardly to the mold coating 161 and casting 168.

Further, because the mold media 40 is so highly electrically conductive, generally in the same range as copper, electrical currents may be passed through the mold media 40 by interconnecting a current source (not shown) to mold electrical terminals 61, 62. Variation and fluxuation of the current may be employed to generate magnetic fields about the mold pattern 160 to affect the molten metal within the mold cavity 165 to generate sought-after mechanical properties.

Referring to the drawings, FIG. 1, which is identified as prior art, shows a known conventional mold flask 50 commonly used in the lost foam process with a foam mold pattern 160 therein. The foam mold pattern 160 has a mold pattern coating 161 to form a hard shell about the foam pattern 160. The coating 161 may be ceramic based. The coated foam pattern 160 is carried inside the mold flask 50 and is supported by silica sand backing media 166. Manipulating hooks 58 provide a means for lifting the flask 50 for transportation to a shakeout area (not shown) after solidification.

Figure 2:
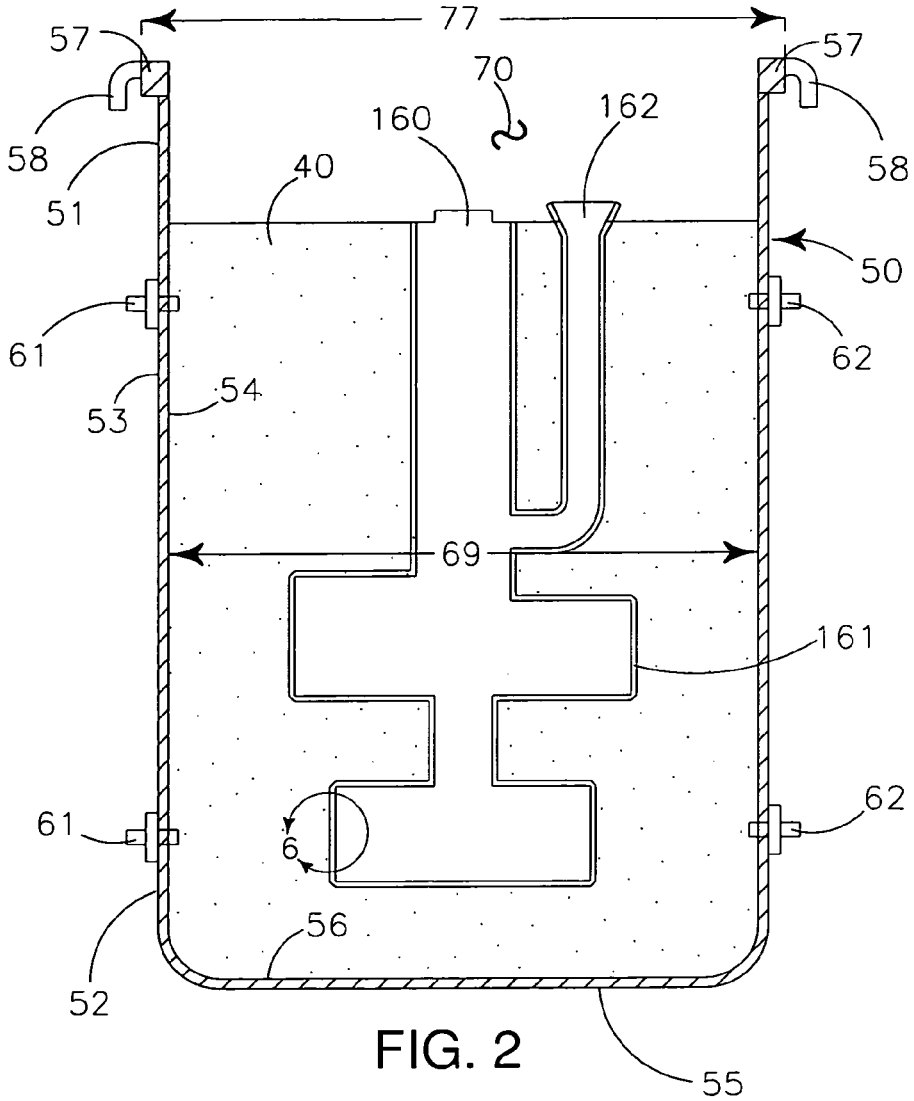
FIG. 2 is a orthographic vertical cross-section view of a thermally-conductive mold flask with electrodes showing a coated foam pattern supported within the flask by my electrically conductive carbon graphite mold backing media.
Figure 6:
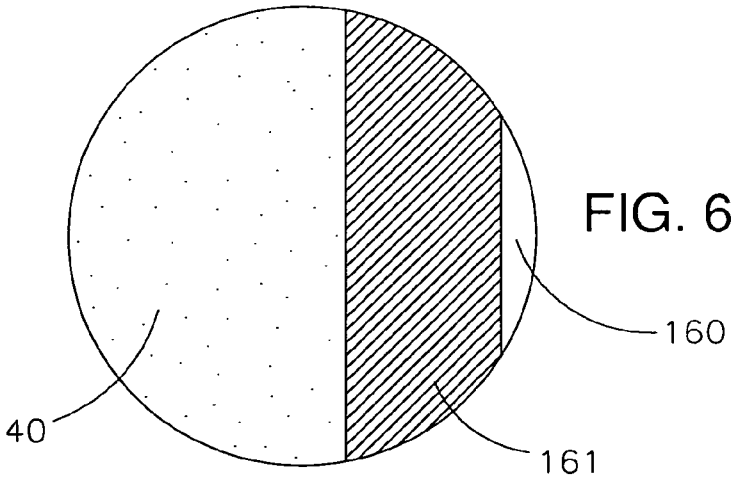
FIG. 6 is an enlarged view of a portion of FIG. 2 showing the carbon graphite mold shell coating the mold pattern.

FIG. 2 shows a first preferred embodiment of my invention being used in the lost foam casting process using a foam pattern 160 similar to that shown in FIG. 1. Mold flask 50 is constructed from a material, preferably copper plate (mild steel is also functional and is less costly), which is thermally and electrically conductive. External electrode terminal connectors 61 and 62 for positive and negative polarity are carried on the outer circumferential surface 53 and extend into and communicate with the electrically conductive and thermally conductive mold media 40 within the volume 70 which has replaced conventional sand media 166. A mold pattern 160 is formed of expanded foam having a carbon graphite, water-soluble binder coating 161 on an exterior surface and is supported within the volume 70 defined by the mold flask 50 by the mold media 40. The foam pattern 160 has low amounts of volatile organic compounds (VOC) so that there is a minimal generation of hydrogen gas (not shown) and oxygen gas (not shown) during decomposition of the foam pattern 160 when the molten metal is poured into the mold cavity 165. The carbon graphite coating 161 (held together with a water soluble binder) extending about the foam pattern 160 has the tendency to adsorb and absorb the off gassing volatile organic compounds (VOC) exiting the mold cavity 165 which reduces the porosity in the casting and reduces the amount of VOC's off gassed, which are subject to EPA regulations and restrictions.

The mold media 40 also increases thermal conductivity from direct instant contact (DIC) of various types of coolants deployed within the mold flask 50, particularly liquid coolants which may increase thermal conductivity by upwards of 100%. Liquid coolants may include but not limited to heated, ambient and/or cooled water, salt water, salt water with totally dissolved salts (TDS), water blended with poly (alkylene), glycol, and other known liquid coolants.

Figure 3:
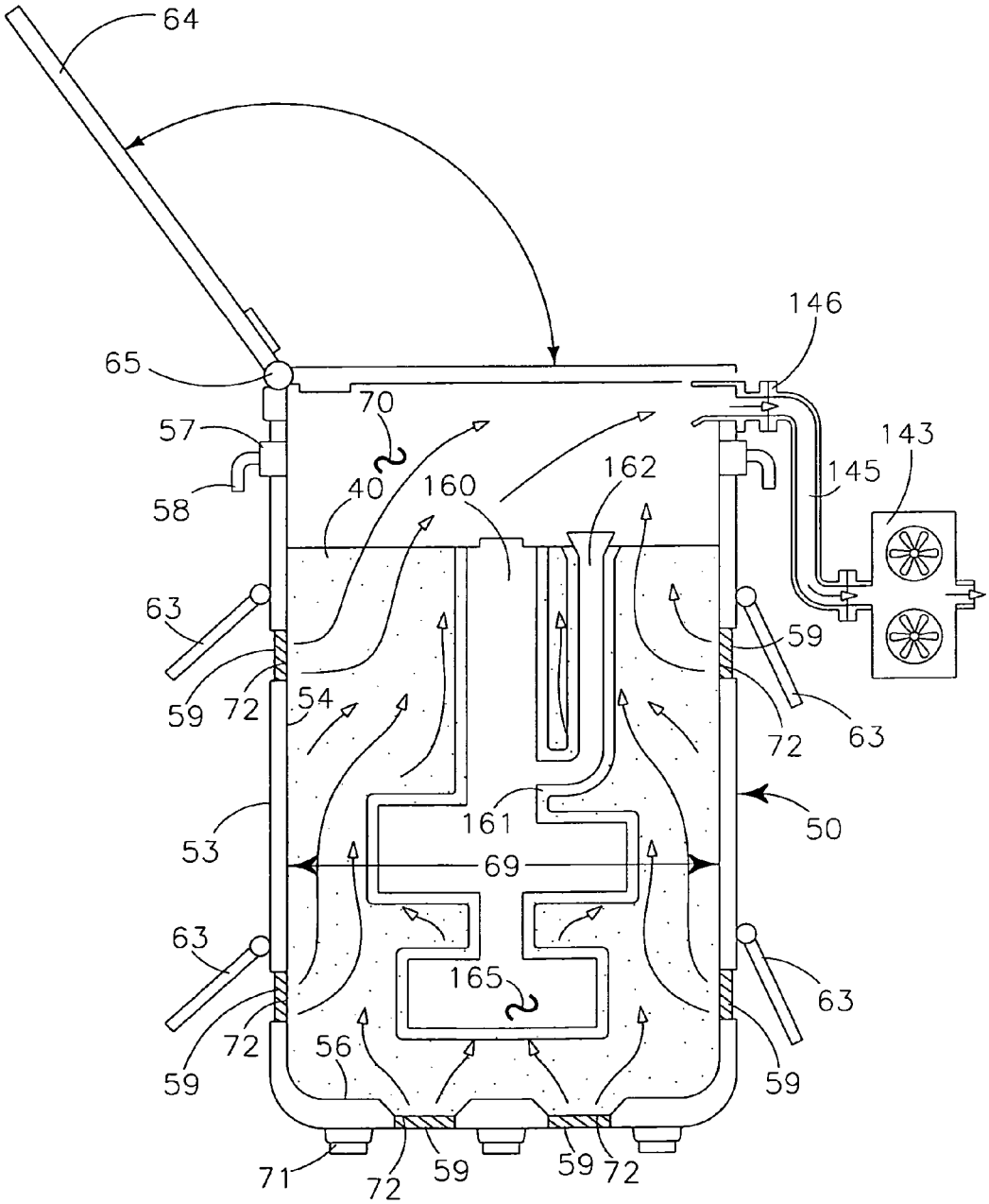
FIG. 3 is an orthographic vertical cross-section view of a first preferred embodiment of my mold flask supporting a coated foam pattern in mold media and having plural coolant ports defined in the mold flask having a vacuum means for drawing coolant through the mold flask.

FIG. 3 is another preferred embodiment of my invention showing a modified mold flask 50 utilized to reduce solidification time and also to improve mechanical properties of the molded shaped castings utilizing the lost foam process. Mold flask 50 is preferably constructed from thermally conductive metals such as, but not limited to copper although mild steel is functional and less costly. The mold flask 50 defines plural spacedly arrayed coolant inflow ports 59 which carry screens 72 adjacent the inner circumferential surface 54 that allow coolant such as air to be drawn into the volume 70 defined by the mold flask 50 at strategic locations (both low and high). The spherical configuration of the mold media particulates 41 has spaces 43 between the particles 41 to facilitate coolant flow and passage that conducts heat away from the mold cavity 165. The particulates 41 of the mold media 40 have a grain size that is larger than openings defined by the screens 72 covering the coolant inflow ports 59. The screen 72 covered coolant inflow ports 59, and the positions of the coolant inflow ports 59 provides directional control of solidification by opening selected inflow ports 59 first while leaving the other inflow ports 59 closed and then opening the remaining inflow ports 59 in a determined timed sequence. A vacuum device 43, communicating with the mold flask 50 draws coolant (air) through the mold flask 50 and through the mold media 40. An air tight lid 64 facilitates the coolant draw through the mold media 40. Legs 71 support the mold flask 50 above a supporting surface and ensure sufficient clearance for coolant flow into the mold flask 50 through coolant input ports 59.

The coolant air may be ambient air, heated air or cooled air, and by means of vacuum device 143, the coolant air is drawn through the mold flask 50 and mold media 40 to draw latent heat away from the molten metal and the casting 168. The "arrows" of FIG. 3 show the direction of coolant flow. Because the coolant air is in direct instant contact (DIC) with the mold media 40 and the mold coating 161, latent heat is rapidly conducted away from the molten metal, causing rapid freezing of the molten metal. Controlled optimized directional solidification occurs by drawing the coolant into the volume 70 of the mold flask 50 and through the thermally conductive mold media 40 and discharging the heated coolant to an off-gas system 146.

After solidification of molten metal in mold cavity 165, the mold container flask 50 is lifted by manipulating hooks 58 and transported to a shakeout station (not shown). The mold flask 50 may thereafter be cleaned and returned for repacking for another casting 168, the mold media 40 is recycled and reused.

Figure 4:
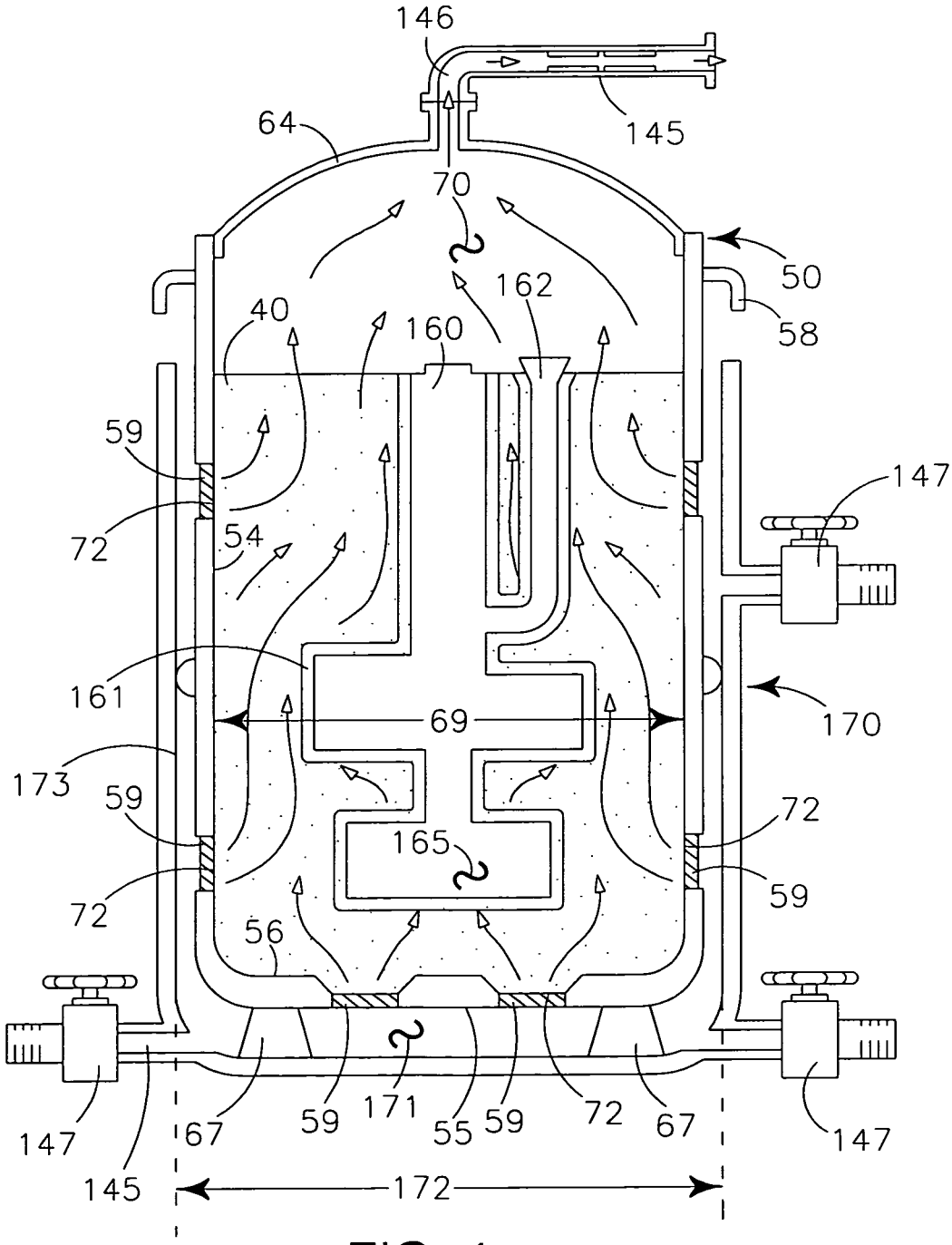
FIG. 4 is an orthographic vertical cross-sectional view of another embodiment of my mold flask within a cooling jacket.

FIG. 4 discloses a liquid cooled embodiment of my invention which shows a mold flask 50 having plural screened 72 inflow 59 ports carried within a cooling jacket 170 for supplying liquid coolant to the mold flask 50 and mold media 40 contained in the volume 70. The cooling jacket 170 defines a volume 171 with an interior diameter 172 between interior circumferential surfaces 173 that is greater than an exterior diameter 77 of the mold flask 50.

The cooling jacket 170 communicates with a coolant supply (not shown) with known plumbing 145 and valves 147. Control of the coolant temperature, coolant level and coolant volume flowing into the mold flask 50 from the cooling jacket 170 allows control over the direction of the molten metal freeze front and rapid solidification of the cast piece. Plural screened 72 coolant input ports 59 defined in the mold flask 50 communicate coolant to desired locations within the mold flask 50 that are predicted to have slower solidification/freeze rates to optimize a desired freeze front for rapid solidification. Predetermined placement of the mold pattern 160 inside the volume 70 will assist in identifying hot spots that may require additional cooling. More particularly, controlled directional rapid solidification may be achieved by deploying coolant into the mold flask 50 at preferred temperatures and at preferred locations. As coolant flows into and through the screened inflow ports 59, the coolant comes into direct instant contact (DIC) with the mold media 40 which has gaps 43 between the particles 41. Heat is transferred outwardly from the molten metal within the mold cavity 165 by the high thermal conductivity of the mold media 40. Controlled exposure to the coolant by adjusting supply, temperature, level and the like creates a directional freeze front for controlled optimized rapid solidification. A removable steam cover lid 64 collects and directs exiting hot gasses produced through the cooling to an off gas system 146. After solidification of the molten metal, which is determined by use of thermal couples 169, coolant may be drained from the cooling jacket via known valves 147. The Mold flask 50 is thereafter lifted and removed from the cooling jacket 170 using the manipulating hooks 58 and transported to a shake out to area. Because the mold media 40 does not use clay type binders, or resin type binders, the mold media 40 may be reclaimed and reused after drying.

Figure 5:
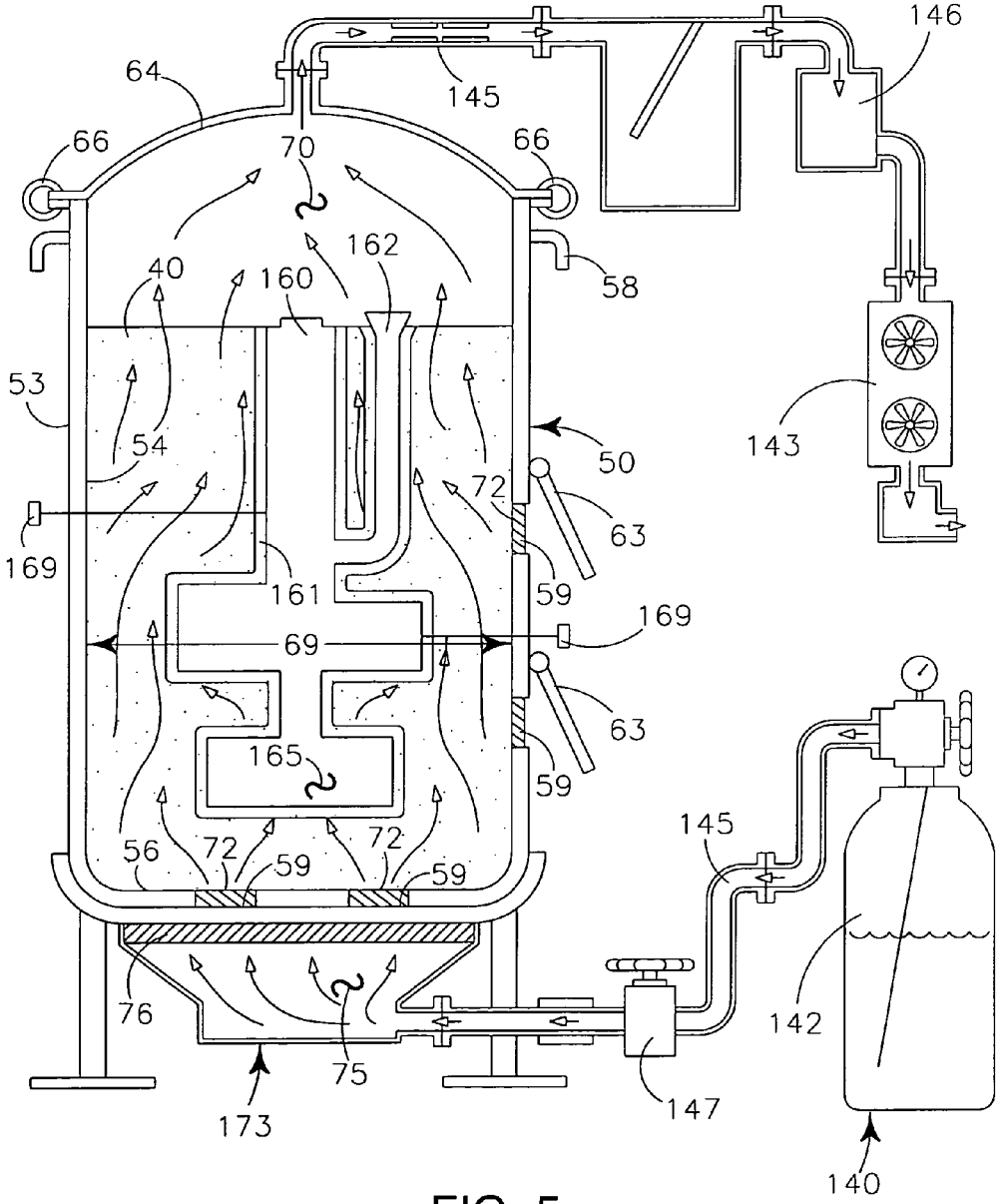
FIG. 5 is an orthographic vertical cross-section view of another embodiment of my mold flask resting upon a base assembly for supplying coolant gas that is drawn through the mold media by a vacuum device.

In a further embodiment, FIG. 5 shows a gas-cooled mold flask 50 defining plural spacedly arrayed screen covered 72 inflow ports 59 defined in the bottom surface 53 for entry of coolants to pass into the mold flask 50 and into the mold media 40 contained therein. A base assembly 73, with plural coolant ports (not shown) defined therein, is positioned so that the exterior bottom surface 55 of the mold flask 50 is received within the base assembly 73. A circumferentially extending seal (not shown) extends about the outer circumferential surface 53 of the mold flask 50 proximate the second end portion 52 to ensure the coolant gas flows into the mold flask 50 rather than passing between the mold flask 50 and the base assembly 73. Lid 64 is carried at the first upper end portion 51 of the mold flask 50. A seal (not shown) communicates with the lid 64 and the flask rim 57 to provide airtight seal therebetween. The lid 64 is secured to the flask 50 by locking means 66. After molten metal is poured into the mold pattern 160 supported by the carbon graphite mold media 40 within the volume 70 of the mold flask 50, the expanded foam is vaporized allowing the molten metal to fill the mold cavity 165 defined by the mold pattern coating 161.

To cool the molten metal within the mold cavity 165, coolant gas is introduced into the mold flask 50. The volume of the coolant gas is controlled by known means by a known regulator (not shown) and valves 147, which control the amount of coolant gas passing into the mold flask 50. In a preferred embodiment, the coolant gas first passes into a collector chamber 75 and then is drawn upwardly through a diffuser plate 76 into the volume 70 defined by the mold flask 50 by vacuum device 143. Because the mold media 40 (FIG. 3) is aggregate, and the aggregate pieces are generally spherical in nature, the coolant gas may pass relatively freely between the aggregate particles 41 and permeate through the mold media 40, drawing heat away from the filled mold cavity 165. In the preferred embodiment, the coolant gas is $CO_2$, Argon, Nitrogen, Liquid Nitrogen, Helium, Liquid Helium, mixtures with air or other approved refrigerants. In the preferred embodiment, the cooling gas or liquid is passed into the mold flask 50 at a temperature ranging from approximately −150° F. to −350° F. but such temperature may be adjusted and changed as desired for the particular metal/alloy being cast and the mechanical properties desired of the metal.

In FIG. 5, the coolant gas is drawn through the mold media 40 by vacuum device 143 which pneumatically communicates with mold flask 50. The vacuum device 143 also provides for treatment of off-gases if treatment is required. The vacuum device 143 provides a means to provide directional control of cooling of the molten metal by opening and closing any of the plural cooling inflow ports 59 at predetermined times, and in a predetermined order.

The rapid directional cooling of the molten metal may be further enhanced by using thermal couples 169 to monitor cooling rates at specific locations within the mold media 40. As noted previously, the objective is to optimize the control of the molten metal solidification, liquid freeze front, the temperature gradient and its direction.

Figure 7:
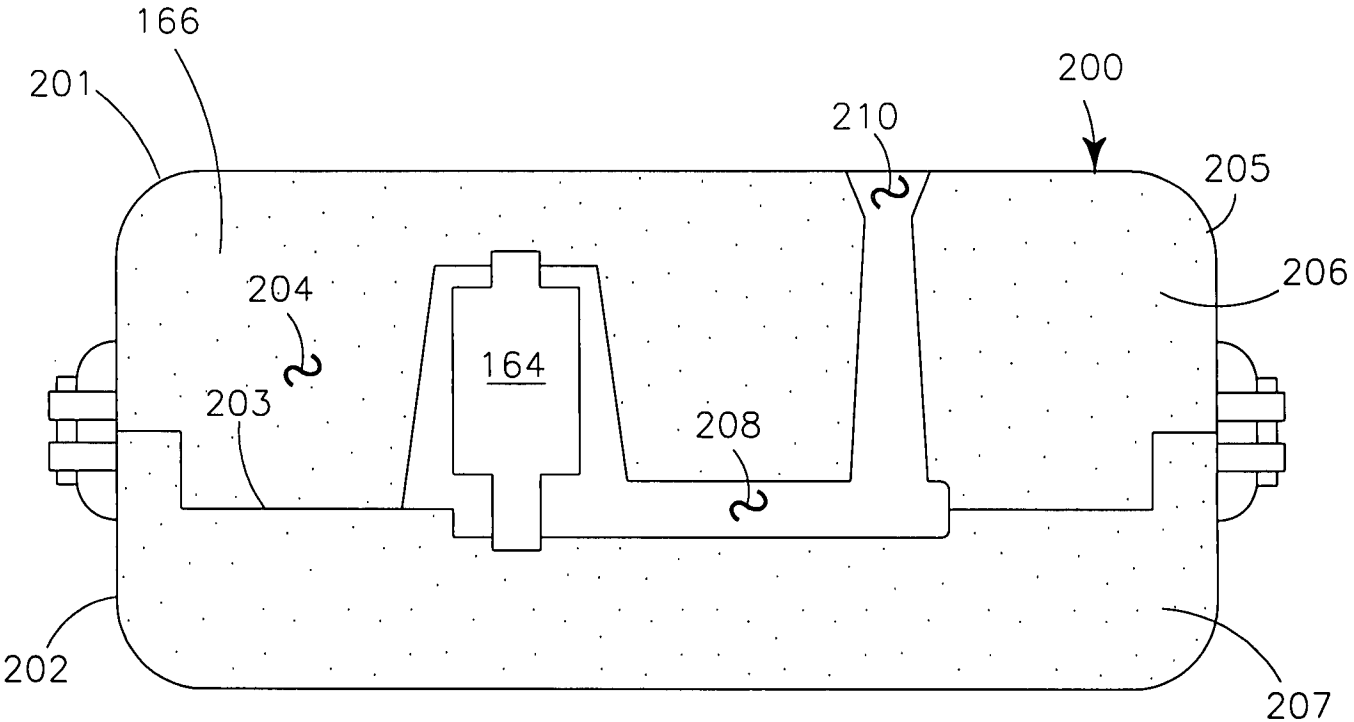
FIG. 7 PRIOR ART
FIG. 7 is an orthographic vertical cross-section view of a prior art cope and drag mold flask carrying a mold pattern and a core in sand.

FIG. 7 discloses a general configuration of a prior art cope and drag sand casting technique utilized for producing sand casted products. Cope and drag may be the oldest and simplest (in theory, but not necessarily in practice) method of casting shaped components. Reusable permanent patterns (not shown) are utilized to make sand molds 206, 207. Two types of sand are commonly used in sand casting with cope and drag molds. "Green sand" consists of a mixture of sand, clay and moisture. Dry sand consists of sand and synthetic resin binders (not shown). The resins may be cured thermally or chemically. Normally, sand molds 206, 207 are filled by pouring molten metal directly into a mold cavity 208. Known sand casting techniques produce average mechanical properties and average porosity of the casted metal piece. Binders (not shown) used in the sand, however, are known to generate noxious and poisonous byproducts that are subject to EPA regulations and restrictions leading to additional costs. Further, the binders reduce the recyclability of the sand used to form the sand molds 206, 207.

Figure 8:
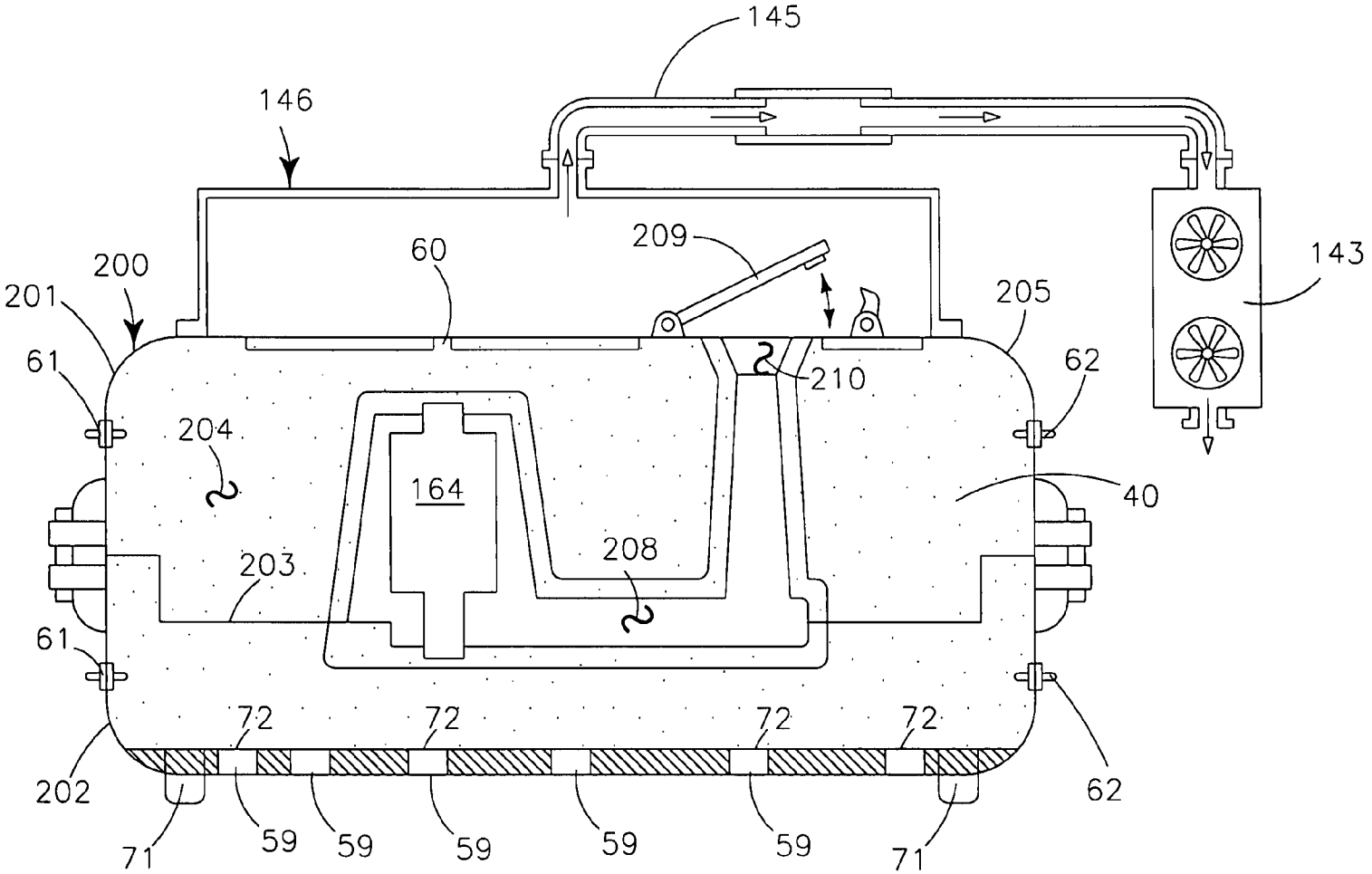
FIG. 8 is an orthographic vertical cross-section view, similar to that of FIG. 7, showing a modified electrically conductive cope and drag mold flask using my carbon graphite mold backing media and carbon graphite mold shell, the flask communicating with a coolant system and having plural coolant orifices.

As shown in FIG. 8, my inventive apparatus and method is also suitable for use in known cope and drag molding. The improved cope and drag mold flask 200 has an upper portion 201 known as a cope mold and a lower portion 202 known as drag mold that join along a mating seam 203. The cope and drag flask 200 defines an interior volume 204 carrying a core mold 164 and is modified with positive and negative electrical terminals 61, 62, respectively, carried on an exterior surface 205 that communicate with the carbon graphite mold media 40 contained within the volume 204 which has replaced the sand media. The electrical terminals 61, 62 provide for application of adjustable voltage and amperage with known electrical apparatus to preheat the mold media 40.

The mold media 40, because it does not require use of binders (clay, chemical, resin, or otherwise) is much more conducive to coolant permeation therethrough for rapid removal of latent heat from the solidifying molten metal especially when the carbon graphite mold media 40 is used in combination with an off gas system 146 and a vacuum device 143 or other air moving means (not shown) that draws coolant through the mold media 40 within the cope and drag flask 200.

After the mold cavity 208 is filled with molten metal, a restrictor cover 209 may be pivoted to a closed position to prevent vacuum from affecting sprue opening 210. An off gas assembly 146 is positioned over the upper cope mold 201 to cover plural outflow ports 60 defined in an upper surface of the cope mold 201. Positioned on a bottom portion of the lower drag mold 202 are plural screened 72 inflow ports 59 which are screened to prevent the mold media 40 from falling therethrough. The inflow ports 59 allow air to be drawn through the mold media 40. When the vacuum device 143 is activated, a directional freeze front is created and the freeze front may be controlled by controlling the vacuum device 143. To promote the cooling, legs 71 provide vertical clearance (preferably at least 4 inches) between a bottom surface of the drag mold 202 and a supporting surface. The solidification rate of the casting within the cope and drag mold 200 is monitored by known thermal couples (not shown) which will provide temperature information when the casting has sufficiently frozen for removal.

Figure 9:
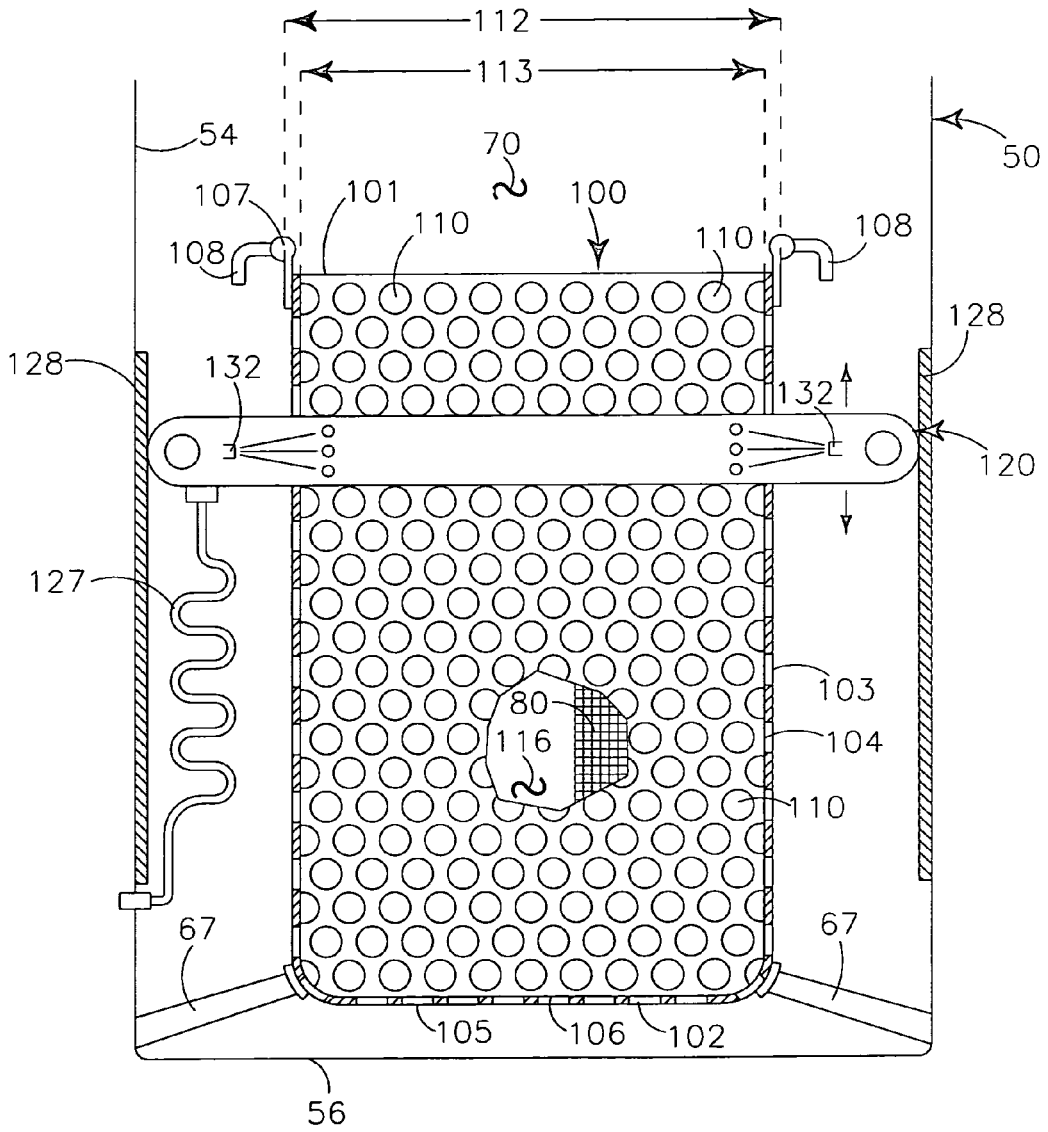
FIG. 9 is an orthographic side view of another embodiment of my apparatus and method showing a vertical cross-sectional view of a mold flask defining a volume and carrying a support flask therein with an annular manifold spray ring mounted to a track system on an inner surface of the outer flask for vertical movement around the support flask.

FIG. 9 shows a further embodiment of my mold flask 50 carrying a support flask 100 within volume 70 defined by the mold flask 50. The support flask 100 preferably has the same configuration as the mold flask 50 (cylindrical) but the same configuration is not required so long as the support flask 100 fits into the volume 70 of the mold flask 50. The support flask 50 defines an interior volume 116 with an inside diameter 113 and an outside diameter 112. The support flask 100 has a first upper end portion 101, a second bottom end portion 102, an outer circumferential surface 103, an inner circumferential surface 104, an exterior bottom surface 105, an interior bottom surface 106, a rim 107 around the outer circumferential surface 103 proximate the first upper end portion 101 and may carry manipulating hooks 108 proximate the rim 107 for movement and transport. The support flask 100 defines a plurality of spacedly arrayed holes 110 in its outer circumferential surface 103 that communicate with the volume 116. The holes 110 shown in FIG. 9 are circular but the holes 110 may have any of a variety of configurations such as, but not limited to, ovals, squares, slots and the like that may better accommodate various coolants that may have varying levels of viscosity. The support flask 100 is configured to allow passage of various coolants into the volume 116 through the plural spacedly arrayed holes 110 when coolant is flooded into the volume 70 of the mold flask 50. Screen flask 80 is carried inside the volume 116 defined by the support flask 100. Screen flask 80 (FIG. 11) is preferably formed of a screen material having a mesh that is sufficiently fine to retain the mold media 40 and yet large enough to permit penetration of coolants therethrough. Spray ring 120 is shown in an orthographic side view in FIG. 9 spraying coolant onto the outer circumferential surface 103 of the support flask 100. Track means 128 within the volume 70 of the mold flask 50 allow the spray ring 120 to move vertically up and down inside the volume 70 of the mold flask 50 proximate the outer circumferential surface 103 of the support track 101. Coolant supply line 127 communicates to the annular spray ring 120.

Figure 10:
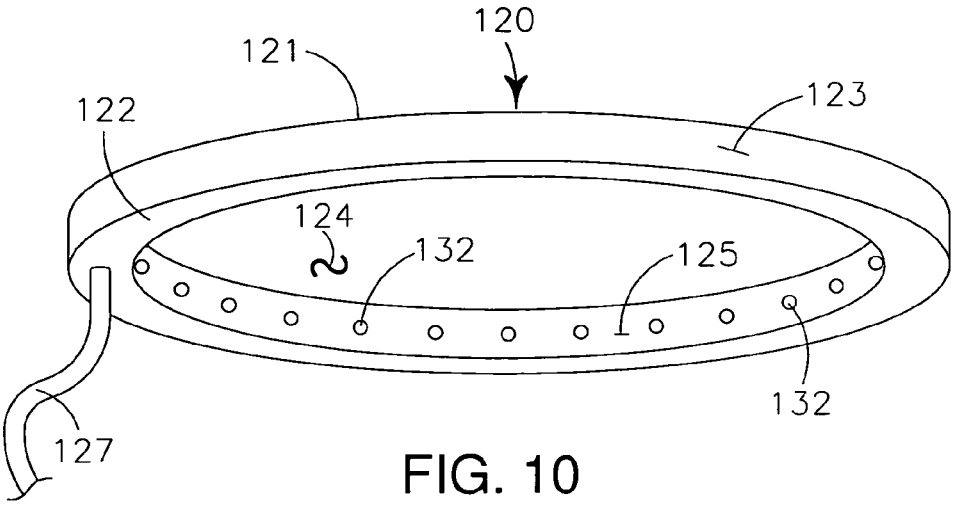
FIG. 10 is an isometric artist's rendition of the spray ring.

As shown in FIG. 10, the annular spray ring 120 is "ring like" in structure and carries on an inner circumferential surface 125 a plurality of spray nozzles 132 for spraying coolant onto the support flask 100 that is positioned within the medial space 124 defined by the annular spray ring 120. A coolant supply line 127 communicates with the spray ring 120 and also communicates with a source of coolant (not shown) that is carried outside the mold flask 50.

Figure 11:
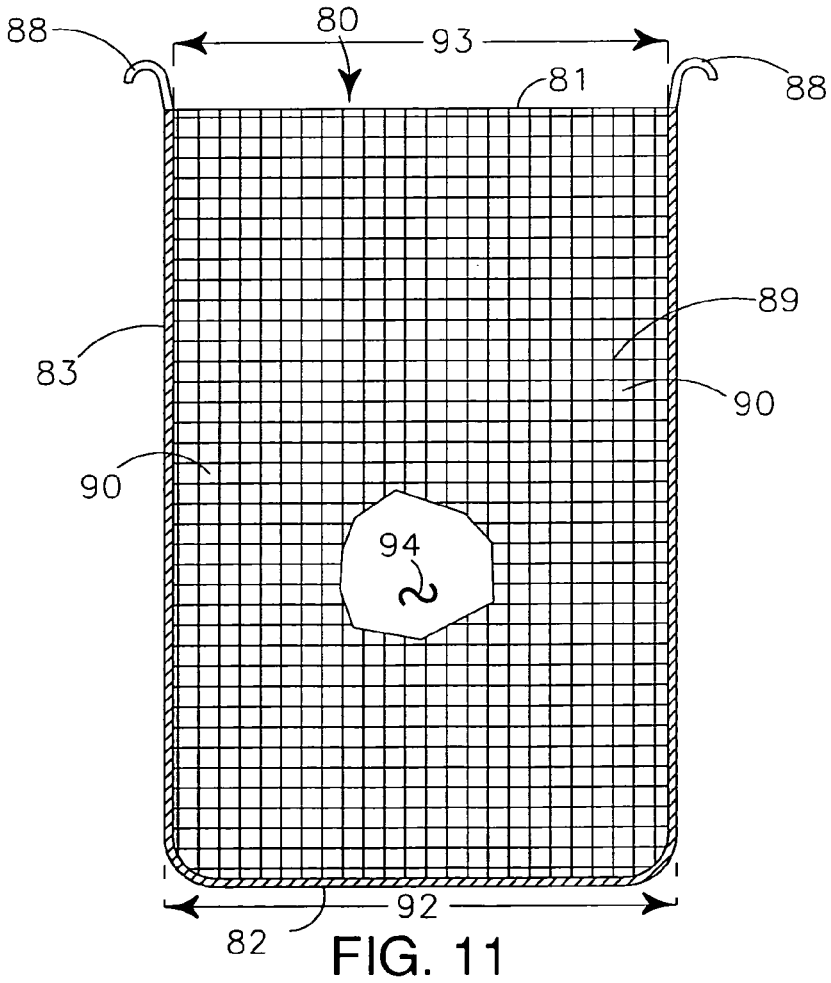
FIG. 11 is an orthographic side view of a screen flask.

FIG. 11 shows a basic design for the screen flask 80 into which the mold media 40 and mold pattern 160 are positioned. The screen flask 60 is formed of a mesh, preferably stainless steel due to its durability and ability to withstand high temperatures and resist corrosion and the like although other materials may also be used, The screen flask 80 has a mesh defining a plurality of openings that are sufficiently small to retain the mold media 40 particulates 41 within a volume 94 defined by the screen flask 60, and sufficiently large enough to allow penetration of coolant therethrough, either by means of flooding the interior volume 70 of the mold flask 50, as well as penetration by coolant sprayed upon the support flask 100 and screen flask 60 by the spray ring 120.

The screen flask 80 is light weight and can be constructed having a variety of size weaves. The function of the screen flask 80 is to retain the mold media 40 and to positionally maintain the mold pattern 160. Lateral and vertical support of the screen flask 80 and mold media 40 and pattern 160 is provided by the support flask 100 which removably carries the screen flask 80 within its volume 116. Because the screen flask 80 and the support flask 100 are removable from the mold flask 50, the screen flask 80 supported within and the support flask 100 may be loaded with mold media 40 and a pattern 160 and packed (such as upon a known vibration table—not shown) outside and separate from the mold flask 50 which may be interconnected to a cooling system 140 and/or vacuum device 143. Further, because the mold flasks 50 are so massive in size and heavy, and costly, the ability to load and pack screen flasks 80 and support flasks 100 separate and apart from the mold flasks 50 means fewer mold flasks 50 are required for casting because the support flasks 100 containing the screen flasks 80 and castings 168 may be removed therefrom allowing the mold flask 50 to be reused for another casting. Further, because the carbon graphite mold media 40 weighs only a fraction of the weight of common sand mold media 166 there is less need for heavy lifting equipment and infrastructure.

Figure 12:
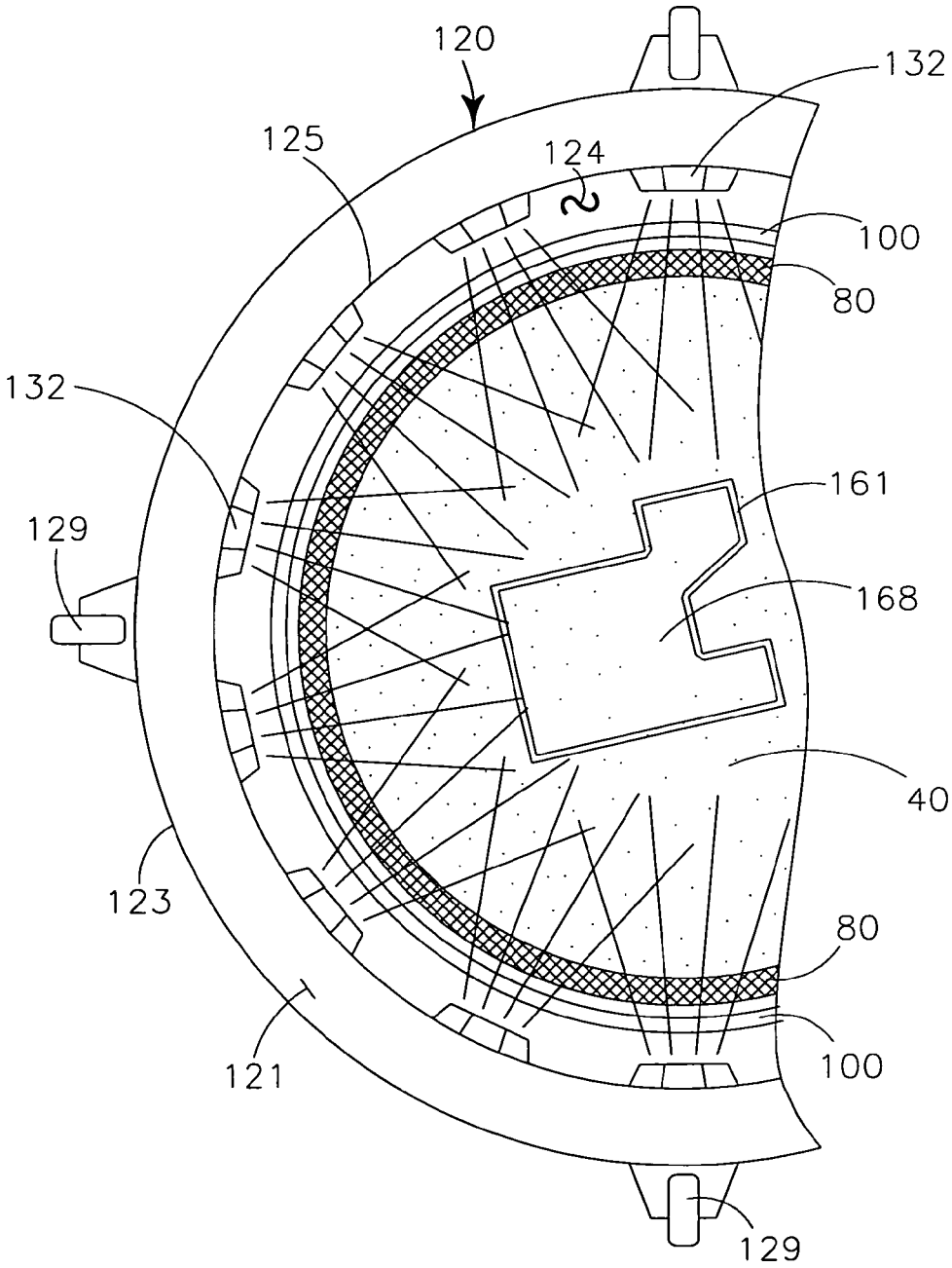
FIG. 12 is an orthographic top, downward looking view of the spray ring spraying coolant onto the support flask and screen flask, containing my carbon graphite mold media and a casting.

FIG. 12 is an orthographic top, downward looking view of an artist's rendition of the spray ring 120 carrying a plurality of spray nozzles 132 which are directing a pressurized spray of coolant onto the support flask 100 carrying the screen flask 80 and the mold media 40 contained within the screen flask 80 to draw heat away from the casting 168.

FIG. 13 is an enlarged artist's rendition of coolant, passing through the support flask 100 and screen flask 80 and thereafter passing through the spaces 43 between the mold material 40 particulates 41 to come into contact with the mold pattern coating 161 defining the mold cavity 165 to draw heat away from the casting.

Figure 14:
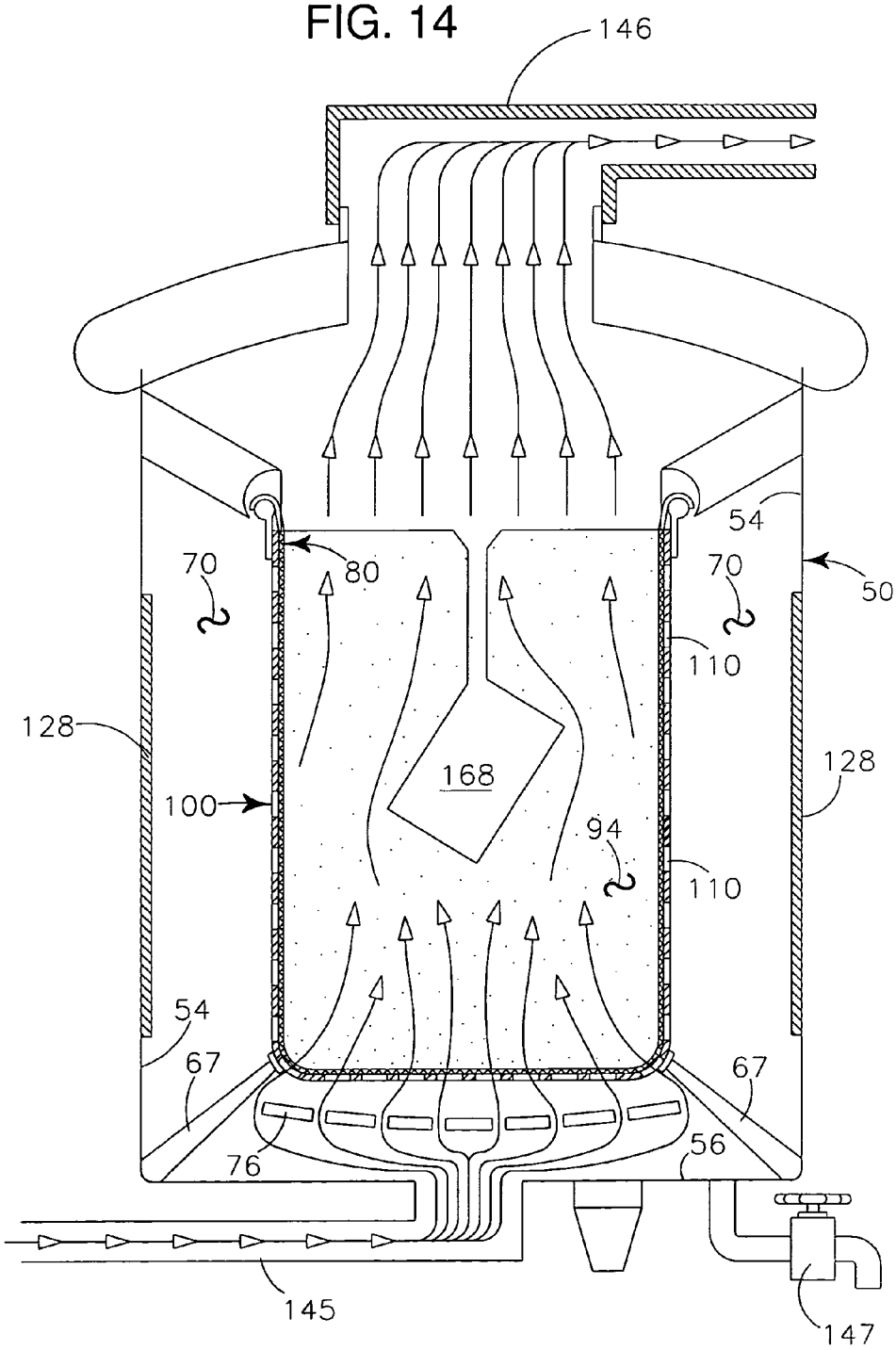
FIG. 14 is an orthographic vertical cross-section, partial cut away view a mold flask, a support flask and a screen flask therein supporting a casting with arrows showing the direction of coolant flow into the mold media to cool the casting.

FIG. 14 shows mold media 40 contained within a screen flask 80 carried within the interior volume 116 defined by the support flask 100 which is inside the volume 70 defined by the mold flask 50. Coolants, such as gases or liquids supplied to the interior volume 70 of the mold flask 50 penetrate through the support flask 100 and the screen flask 80 to draw the heat away from the casting 168. Fumes and heat are evacuated from the volume 70 of the mold flask 50 by a known off gas system 146.

Figure 16:
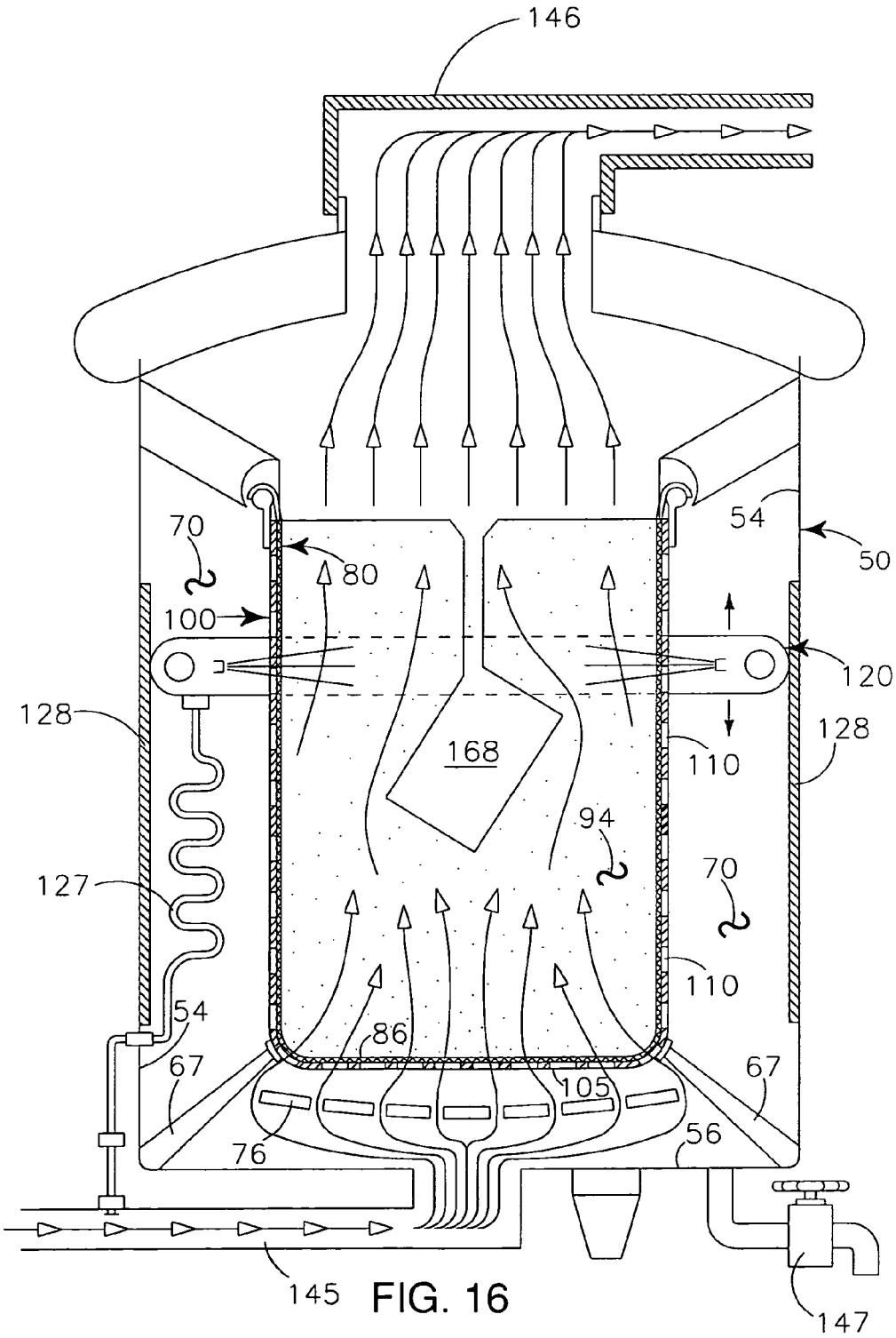
FIG. 16 is an orthographic vertical cross section partial cut away view of a mold flask containing a support flask and a screen flask therein supporting a casting, showing coolant flow into the flask and showing the vertically moveable spray ring spraying coolant on to the support flask and screen flask.
Figure 17:
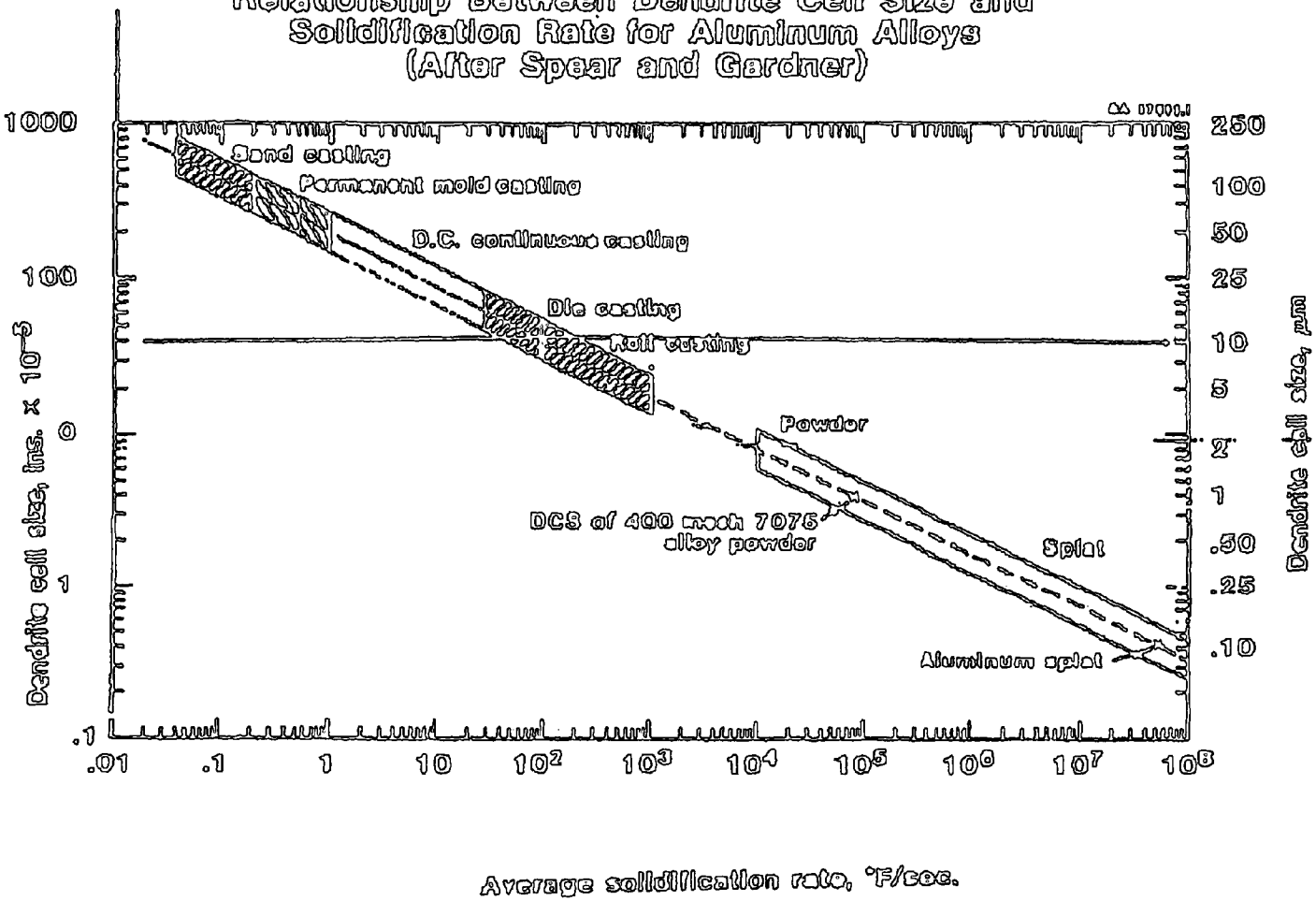
FIG. 17 is a chart showing the relationship between dendrite cell size and solidification rates by time using a variety of casting processes.

FIG. 16 shows a combination of my improved apparatus and method system shown in FIG. 14 wherein coolant gas is injected into the interior volume 70 of the mold flask 50 to penetrate through support flask 100 and through the screen flask 50 to provide cooling to the casting 168. In addition to the coolant being directed into the volume 70 defined by the mold flask 50, the annular spray ring 120 moves vertically on track means 128 carried on the inner circumferential surface 54 of the mold flask 50. Spray nozzles 132 carried on the inner circumferential surface 125 of the spray ring 120 spray pressurized coolant onto the support flask 100 and the screen flask 80. The coolant permeates through holes 110 defined in the support flask 100 and holes 90 defined in the screen flask 80 and passes through spaces 43 between the mold media 40 particulates 41 to contact the casting 168 to draw heat away from the casting 168 to promote solidification. My apparatus and method using both the coolant gas directed into the volume 70 defined by the mold flask 50 to pass through the support flask 100 and the screen flask 80, in addition to the annular spray ring 120, generates rapid directionally controlled solidification of the casting 168 to generate the desired mechanical characteristics of the resulting casting 168. The coolant gases entering the second bottom portion 52 of the mold flask 50 begin cooling lower portions of the casting 168 first while upper portions of the casting 170 would normally remain hot (and fluidic) for a longer period of time. Through implementing the use of the annular spray ring 120 my apparatus and method makes it possible to cool the entire casting 168 at the same rate, and if desired cool upper portions of the casting 170 at a faster rate than the lower portions of the casting to generate the mechanical characteristics desired of the ultimate casting 168.

Figure 15:
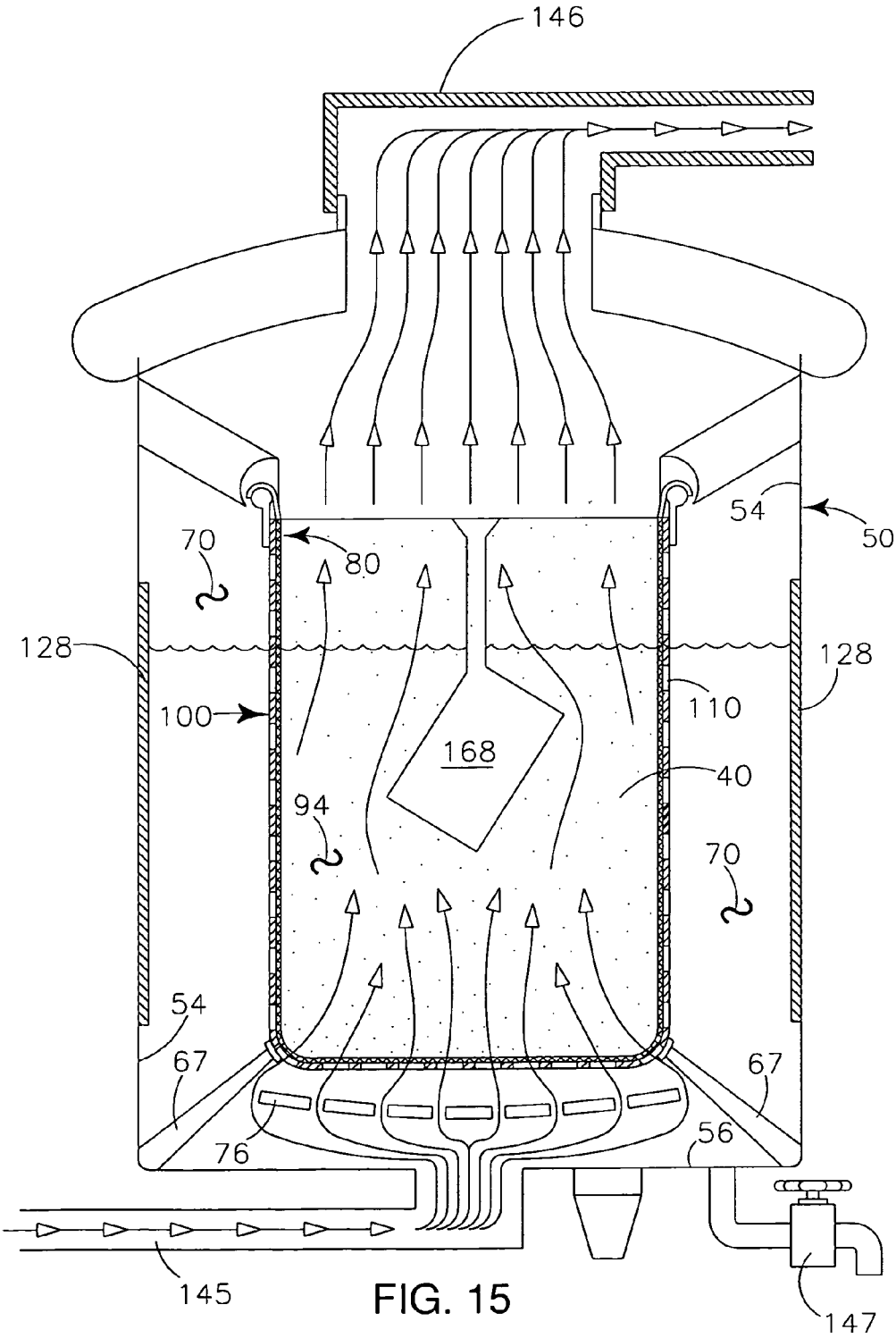
FIG. 15 is an orthographic vertical cross section partial cut away view, similar to that of FIG. 14 showing fluidic coolant flowing into the interior volume of a mold flask to cool the mold media and casting within the support flask and screen flask.

FIG. 15 shows a variation of the system shown in FIG. 14 with a coolant fluid, such as but not limited to water, oil, or oil water blends (and the like) flooded into the interior volume 70 of the mold flask 50 to cool the casting 170 contained within the mold media 40 contained within the screen flask 80. Similar to FIGS. 4, 15 and 16, steam and byproducts generated by the cooling are drawn off through an off gas system known to those in the art.

EXAMPLES

Three common aluminum alloys are A201, A206 and A356.

Various tempering techniques may used to harden metal alloys and two of the most common tempering methodologies are known as T4 and T6. T4 tempering indicates that the alloy has been solution heat treated and quenched to improve mechanical properties. The T6 tempering designation indicates that the alloy was solution heat treated, quenched and artificially aged to generate maximum tensile and yield strengths while preserving adequate elongation. The aging stabilizes the properties. It is well known that while one tempering will cause more tensile strength and less elongation, another will produce less tensile and better elongation. One tempering may produce better fatigue resistance but lower tensile and higher elongation. Tempering also reduces "residual stress" which can cause cracks or warp when the casted piece is heated in the intended application. The tempering process selected and used is therefore determined by the desired mechanical characteristics of the finished casting.

The quality of a cast aluminum alloy part is generally determined by testing the tensile strength, the yield strength and the percentage of elongation of the metal alloy. The chart below shows typical tensile strength, yield strength, and elongation of the identified aluminum alloys produced by known lost foam coating processes and techniques.

Typical mechanical characteristics using known casting methods

| Aluminum Alloy | Tensile (ksi) | Yield (ksi) | % Elongation |
|---|---|---|---|
| A206-T4 | 55 | 36 | 10 |
| A356-T6 | 34 | 24 | 3.5 |

The above identified tensile, yield strength and elongation percentages are averages for known methods of lost foam casting.

Testing of metal castings 168 using my improved lost foam casting process, and my synthetic carbon graphite mold media 40, my modified mold flasks 50, 80, 100 and my annular spray ring 120 that provide rapid controlled cooling and controlled optimized directional control of a freeze front, has shown substantial improvements in the mechanical characteristics of A201, A206 and A356 aluminum alloys. The following table shows the results of tests of aluminum alloy samples produced with my new apparatus and method:

Improved Mechanical Characteristics Using the Instant Method and Apparatus

| Aluminum Alloy | Lab test # | Tensile (ksi) | % Improvement | Yield (ksi) | % Improvement | % Elongation | % Improvement |
|---|---|---|---|---|---|---|---|
| A206-T4 | 85382-3 | 71.4 | 29.8% | 36.4 | .01% | 21.0 | 101% |
| A356-T6 | 151099-2 | 41.9 | 23.2% | 37.7 | 57% | 16.4 | 468% |
| A356.2-T6 | 151099-1 | 42.2 | 24% | 38.0 | 58% | 17.1 | 488% |

As can be seen from the test results, my inventive apparatus and method significantly improve the mechanical characteristics of aluminum 206 in the T4 tempering, as well as A356 in the T6 tempering.

Various portions and components of apparatus within the scope of the inventions, including for example, structural components, can be formed by one or more various suitable manufacturing processes known to those in the art of casting metal items. Similarly, various portions and components of apparatus within the scope of the inventions can be made from suitable materials known to those in the art of casting metal items.

The above description has set out various features, functions, methods and other aspects of my invention. This has been done with regard to the currently preferred embodiments thereof. Time and further development may change the manner in which the various aspects are implemented.

The scope of protection accorded the inventions as defined by the claims is not intended to be limited to the specific sizes, shapes, features or other aspects of the currently preferred embodiments shown and described. The claimed inventions may be implemented or embodied in other forms while still being within the concepts shown, described and claimed herein. Also included are equivalents of the inventions which can be made without departing from the scope of concepts properly protected hereby.

Having thusly described and disclosed my Improved Apparatus and Method for Controlled Optimized Rapid Directional Solidification of Mold Shaped Metal Castings, I file this Utility Patent Application and I pray for issuance of UTILITY LETTERS PATENT.

I claim:

1. An apparatus for optimized controlled rapid directional solidification of mold shaped metal castings comprising in combination:

a mold flask having an upper end portion, an opposing lower end portion an outer surface and an inner surface and defining an interior volume;

ports defined in the mold flask communicating from the outer surface to the interior volume for passage of coolant therethrough; and carbon graphite mold media filling the interior volume of the mold flask to support a mold defining a mold cavity, the carbon graphite mold media being electrically conductive and thermally conductive.

2. The apparatus of claim 1 further comprising:

a removable lid on the mold flask to enclose the interior volume.

3. The apparatus of claim 1 further comprising:

cooling means communicating with the mold flask to draw coolant through the ports and through the mold media to draw heat away from hot metal within the mold cavity.

4. The apparatus of claim 1 further comprising:

electrical terminals on an electrically conductive mold flask, the electrical terminals communicating with the carbon graphite mold media within the interior volume for application of electrical current to the mold media to heat the mold.

5. The apparatus of claim 1 further comprising:

opening and closing port closures communicating with the ports defined in the mold flask, the port closures to be opened and closed in a controlled sequence to control the rate of cooling of hot metal within the mold cavity.

6. The apparatus of claim 1 further comprising:

a mold coating about the mold pattern, the mold coating formed of the carbon graphite mold media and a water soluble binder.

7. The apparatus of claim 1 further comprising:

coolant supply means communicating with the ports defined in the mold flask for supplying coolant to the interior volume.

8. The apparatus of claim 1 further comprising:

a support flask removably carried within the interior volume of the mold flask, the support flask having an open upper end portion, an opposing closed lower end portion, an outer surface, an inner surface and defining an interior volume, and plural holes defined in the support flask communicating from the outer surface to the interior volume for passage of coolant therethrough;

a screen removably carried within the interior volume of the support flask, the screen flask having an open upper end portion, an opposing closed lower end portion, an outer surface, an inner surface and defining an interior volume, and a plurality of holes defined in the screen flask communicating from the outer surface to the interior volume for passage of coolant therethrough to contact the carbon graphite mold media carried within the interior volume of the screen flask.

9. The apparatus of claim 8 further comprising:

an annular spray ring carried within the interior volume of the mold flask and movable vertically between the upper end portion and lower end portion of the mold flask, the spray ring defining a medial space defined by an inner circumferential surface and communicating with a source of coolant;

plural spacedly arrayed spray nozzles carried on the inner circumferential surface of the annular spray ring to disperse coolant therefrom onto the outer surface of the support flask carried within the interior volume of the mold flask.

10. The apparatus of claim 1 wherein:

the carbon graphite mold media is comprised of particulates having a generally spherical surface configuration so that gaps and spaces are maintained between the individual carbon graphite mold media particulates for coolants to pass therethrough.

11. The apparatus of claim 1 wherein:

fluidic and gaseous coolants are supplied to the mold flask in sequence to optimize cooling of hot metal within the mold cavity.

12. A method for optimized controlled rapid directional solidification of mold shaped metal castings comprising the steps:

positioning a screen flask into an interior volume defined by a support flask so that the screen flask has lateral and vertical support to positionally maintain a mold pattern;

positioning the mold pattern having a mold coating thereon in an interior volume defined by the screen flask;

filling the interior volume of the screen flask with carbon graphite mold media to positionally maintain and support the mold pattern;

positioning the support flask containing the screen flask, mold pattern and carbon graphite mold media into an interior volume defined by a mold flask, the mold flask, having an upper end portion, an opposing lower end portion an outer surface, an inner surface, a removable lid, plural spacedly arrayed opening and closing ports communicating from the outer surface to the interior volume for passage of coolant therethrough; and a cooling means for drawing coolant through the ports and into the mold media;

pouring molten metal into the mold pattern to dissipate the mold pattern and fill a mold cavity defined by the mold coating;

cooling the molten metal within the mold cavity by drawing coolant into and through the interior volume of the mold flask and into the mold media; and optimizing the cooling of the molten metal by application of varying coolants and varying times and by opening and closing the ports at varying times.

13. The method of claim 12 further comprising:

an annular spray ring carried within the interior volume of the mold flask and movable vertically between the upper end portion and lower end portion, the spray ring defining a medial space defined by an inner circumferential surface and communicating with a source of coolant;

plural spacedly arrayed spray nozzles carried on the inner circumferential surface of the annular spray ring to disperse coolant therefrom onto the outer surface of a flask carried within the interior volume of the mold flask.

* * * * *